US007552762B2

(12) United States Patent
Khazanovich et al.

(10) Patent No.: US 7,552,762 B2
(45) Date of Patent: Jun. 30, 2009

(54) METHOD AND APPARATUS TO PROVIDE ELECTRICAL CONNECTION IN A WELLHEAD FOR A DOWNHOLE ELECTRICAL DEVICE

(75) Inventors: Abram Khazanovich, Edmonton (CA); Irina Khazanovich, Edmonton (CA); Nathan Kwasniewski, Sherwood Park (CA)

(73) Assignee: Stream-Flo Industries Ltd., Edmonton (CA)

( * ) Notice: Subject to any disclaimer, the term of this patent is extended or adjusted under 35 U.S.C. 154(b) by 0 days.

(21) Appl. No.: 11/610,345

(22) Filed: Dec. 13, 2006

(65) Prior Publication Data

US 2007/0137863 A1 Jun. 21, 2007

Related U.S. Application Data

(63) Continuation-in-part of application No. 10/913,710, filed on Aug. 5, 2004, now Pat. No. 7,410,002.

(60) Provisional application No. 60/493,097, filed on Aug. 5, 2003.

(51) Int. Cl.
*E21B 19/00* (2006.01)

(52) U.S. Cl. ..... 166/75.14; 166/379; 166/382; 166/65.1; 166/66.6; 439/190; 439/192; 439/194

(58) Field of Classification Search ..... 166/65.1, 166/57, 379, 382, 66.6, 75.14, 55, 60; 439/190, 439/192, 194
See application file for complete search history.

(56) References Cited

U.S. PATENT DOCUMENTS 2,548,360 A 4/1951 Germain
2,597,261 A 5/1952 Rhoads
2,634,961 A 4/1953 Ljungstrum
2,728,396 A 12/1955 Carpenter
2,732,195 A 1/1956 Ljungstrum
2,780,450 A 2/1957 Ljungstrum
2,789,805 A 4/1957 Ljungstrum
2,812,818 A 11/1957 Brusco
2,923,535 A 2/1960 Ljungstrum
2,982,354 A 5/1961 Green
3,294,169 A 12/1966 O'Brien
3,638,732 A * 2/1972 Huntsinger et al. ..... 166/379

(Continued)

*Primary Examiner*—Jennifer H Gay
*Assistant Examiner*—Brad Harcourt
(74) *Attorney, Agent, or Firm*—Greenlee, Winner and Sullivan, P.C.

(57) ABSTRACT

Wellhead assembly and method for providing a power connection to a downhole electrical device, such as a heater. Pressure-containing wellhead body members enclose a vertical wellbore and support therein an isolated tubing hanger and a grounding tubing hanger. The isolated tubing hanger suspends a conducting tubing string, while the grounding tubing hanger suspends a grounding tubing string concentrically spaced from the conducting tubing string. The isolated tubing hanger has an outer housing, an inner electrically conducting portion supported by the outer housing operative to provide electrical connection with, and suspend, the conducting tubing string, and insulation between the housing and conducting portion to electrically isolate the housing portion. Hot electrical connection is made for electrical connection to the conducting portion of the isolated tubing hanger or the conducting tubing string. Electrical isolation seals and electrically isolates the hot electrical connection from the wellhead body members. Grounding connection is provided to a wellhead body member. A source of current provides a first connection to the hot electrical connection and a second connection to the grounding connection.

13 Claims, 26 Drawing Sheets

U.S. PATENT DOCUMENTS 4,491,176 A 1/1985 Reed
4,500,263 A 2/1985 Mohn
4,570,715 A 2/1986 Van Meurs et al.
4,627,489 A 12/1986 Reed
4,716,960 A 1/1988 Eastlund et al.
4,886,114 A * 12/1989 Perkins et al. ..... 166/66.7
4,886,118 A 12/1989 Van Meurs et al.
4,923,006 A 5/1990 Hartmann et al.
5,060,287 A 10/1991 Van Egmond
5,065,818 A 11/1991 Van Egmond
5,280,766 A 1/1994 Mohn
5,544,707 A 8/1996 Hopper et al.
5,558,532 A 9/1996 Hopper
5,794,693 A 8/1998 Wright et al.
6,023,554 A 2/2000 Vinegar et al.
6,039,119 A 3/2000 Hopper et al.
6,112,808 A 9/2000 Isted
6,200,152 B1 3/2001 Hopper
6,269,876 B1 8/2001 De Rouffignac et al.
6,360,819 B1 3/2002 Vinegar
6,581,684 B2 6/2003 Wellington et al.
6,585,046 B2 7/2003 Neuroth et al.
6,588,503 B2 7/2003 Karanikas et al.
6,588,504 B2 7/2003 Wellington et al.
6,591,906 B2 7/2003 Wellington et al.
6,591,907 B2 7/2003 Zhang et al.
6,662,875 B2 12/2003 Bass et al.
6,679,332 B2 1/2004 Vinegar et al.
6,681,861 B2 1/2004 Davidson et al.
6,686,745 B2 2/2004 Bass
6,763,882 B2 7/2004 Demney et al.
6,763,887 B2 7/2004 Boyadjieff
7,004,247 B2 2/2006 Cole et al.
7,084,782 B2 8/2006 Davies et al.
2002/0023751 A1 2/2002 Neuroth et al.
2007/0018848 A1 1/2007 Bottos et al.

* cited by examiner

METHOD AND APPARATUS TO PROVIDE ELECTRICAL CONNECTION IN A WELLHEAD FOR A DOWNHOLE ELECTRICAL DEVICE

CROSS-REFERENCE TO RELATED APPLICATIONS

This application is a Continuation-In-Part of U.S. patent application Ser. No. 10/913,710, filed Aug. 5, 2004, which is pending. This application also claims the benefit of U.S. Provisional Application 60/493,097, filed Aug. 5, 2003. Both applications are incorporated herein in their entirety to the extent not inconsistent herewith.

FIELD OF INVENTION

The invention provides method and apparatus to provide electrical connection in a wellhead for a downhole electrical device.

BACKGROUND OF THE INVENTION

Power is often needed to be provided to downhole electrical devices such as pumps and heaters. Electrical heaters may be used to heat the subterranean formation by radiation and/or conduction, or the heater may resistively heat an element. U.S. Pat. No. 6,023,554 to Vinegar et al., assigned to Shell Oil Company, describes an electrical heating element that is positioned within a casing. The heating element generates radiant energy that heats the casing. A granular solid fill material may be placed between the casing and the formation. The casing may conductively heat the fill material, which in turn conductively heats the formation. While a large number of patents are directed to methods of heating a subterranean formation, very few patents provide the necessary teachings to provide wellhead equipment capable of providing the high voltages likely to be needed to heat heavy oil formations, while maintaining well control in pressure environments. For instance, in U.S. Pat. No. 7,004,247 to Cole et al., assigned to Shell Oil Company, it is noted that, for heaters greater than about 700 m in length, voltages greater than about 2000 V may be needed for generating heat, compared to voltages of about 480 V that may be used for heaters having lengths less than about 225 m.

U.S. Pat. No. 4,716,960 to Eastlund et al., describes electrically heating of the tubing of a petroleum well by passing a relatively low voltage current through the tubing to prevent formation of solids. Isolated tubing hangers are known in the oil and gas industry. They are often used when providing an electrical connection to one or more downhole electrical devices such as pumps or electrical instruments. However, for the most part, the power is supplied by electrical cables, which are accommodated through a tubing hanger by feed through connectors which provide electrical isolation from the hanger. Exemplary patents relating to insulated tubing hangers include U.S. Pat. No. 4,923,006 to Hartmann et al. and U.S. Pat. No. 6,763,882, issued Jul. 20, 2004 to Demny et al. U.S. Pat. No. 5,280,766 to Mohn describes a subsea wellhead system in which concentric tubular conductors with insulating sleeves therebetween are used to provide power to a pump. Few details for providing the electrical connection at the wellhead are provided.

In general, the prior art patents are not directed to the unique problems associated with the provision of high voltage to downhole electrical devices through wellhead tubing strings under pressure-containing and electrical isolating conditions. For instance, the current needed to run downhole instrumentation, pumps or even to heat a tubing to prevent a wax build up, is minor compared to that needed to run downhole heaters in heavy oil reservoirs.

As well, the patents relating to isolated tubing hangers suffer the disadvantage of not providing a feature for making an electrical connection at the wellhead when the well is under pressure.

SUMMARY OF THE INVENTION

In a broad aspect, the invention provides a wellhead assembly for providing a power connection to a downhole electrical device, including:

a. one or more pressure-containing wellhead body members enclosing a vertical wellbore extending there through, the one or more body members supporting, in sealed relationship in the vertical wellbore, an isolated tubing hanger and a grounding tubing hanger, the isolated tubing hanger suspending therefrom a conducting tubing string, and the grounding tubing hanger suspending therefrom a grounding tubing string concentrically spaced from the conducting tubing string, both of the tubing strings being electrically conductive and electrically connected to the downhole electrical device;

b. the isolated tubing hanger having an outer housing which seats in one of the one or more wellhead members, an inner electrically conducting portion supported by the outer housing operative to provide electrical connection to, and suspend, the conducting tubing string, and insulation between the housing and the conducting portion to electrically isolate the housing portion from the conducting portion;

c. a hot electrical connection for making an electrical connection to the conducting tubing string or to the conducting portion of the isolated tubing hanger;

d. electrical isolation associated with the hot electrical connection and the one or more wellhead body members for sealing and electrically isolating the hot electrical connection such that the one or more wellhead body members remain electrically isolated from the hot electrical connection;

e. a grounding connection connected to the one or more wellhead body members for making a ground connection to the grounding tubing string; and f. a source of current having a first connection to the hot electrical connection and a second connection to the grounding connection.

Preferably, the one or more body members form separate first and second tubing hanger profiles to support the grounding tubing hanger and the isolated tubing hanger in vertically stacked relationship in the vertical wellbore. Preferably, the conducting portion of the isolated tubing hanger includes a conducting neck portion extending upwardly relative to the housing of the isolated tubing hanger; and the hot electrical connection connects to the conducting neck portion outside the vertical wellbore.

The invention also broadly extends to a hot electrical connection assembly in a wellhead for providing a power connection to a tubing string extending to a downhole electrical device. The hot electrical connection assembly includes:

a. one or more pressure-containing wellhead body members enclosing a vertical wellbore extending there through, the one or more body members supporting, in sealed relationship in the vertical wellbore, an isolated tubing hanger, the isolated tubing hanger suspending therefrom a conducting tubing string electrically connected to the downhole electrical device;

b. the isolated tubing hanger having an outer housing which seats in the one of the one or more wellhead members, an inner electrically conducting portion supported by the outer housing operative to provide electrical connection to, and suspend, the conducting tubing string, and insulation between the housing and the conducting portion to electrically isolate the housing portion from the conducting portion;

c. a hot electrical connection for making an electrical connection to the conducting tubing string or to the conducting portion of the isolated tubing hanger; and d. electrical isolation associated with the hot electrical connection and the one or more wellhead members for sealing and electrically isolating the hot electrical connection such that the one or more wellhead body members remain electrically isolated from the hot electrical connection.

The invention also broadly extends to an isolated tubing hanger for suspending a conducting tubing string within a pressure-containing tubing head. The isolated tubing hanger includes:

a. an outer housing which seats in the tubing head, an inner electrically conducting portion supported by the outer housing operative to provide electrical connection to, and suspend, the conducting tubing string, and insulation between the housing and the conducting portion to electrically isolate the housing portion from the conducting portion;

b. the housing forming a central bore with an inwardly extending circumferential landing seat at its lower end, and carrying outer circumferential seals to seal with the tubing head;

c. the conducting portion of the isolated tubing hanger including a landing shoulder to seat on the landing seat, and a conducting neck portion connected to, or integral with, the conducting portion extending upwardly relative to the housing, said conducting neck portion providing the electrical connection to the conducting tubing string;

d. the insulation including load supporting insulation plates located above and below the landing shoulder, and a plurality of insulation sleeves between the housing and the conducting portion;

e. one or more seals between the landing shoulder and the landing seat to seal the conducting portion of the isolated tubing hanger with the housing; and f. a retainer ring at the top of the housing around the conducting neck portion to retain, seal and energize the insulation and the one or more seals.

In yet another broad aspect, the invention provides a method for providing a power connection from a source of current located at a wellhead to a downhole electrical device, wherein the wellhead includes one or more pressure-containing wellhead body members forming a vertical wellbore extending there through, the one or more wellhead body members being operative to support, in sealed relationship in the vertical wellbore, a first and a second tubing hanger, each tubing hanger being operative to suspend therefrom a tubing string such that a first and a second tubing string are concentrically spaced from each other. The method includes:

a. providing electrical isolation to the first of the tubing hangers such that an outer housing of the first tubing hanger is electrically isolated from an inner, electrically conducting portion of the first tubing hanger;

b. suspending the first tubing string from the electrically conducting portion of the first tubing hanger;

c. providing insulation between the outer housing and the inner conducting portion of the first tubing hanger to electrically isolate the outer housing portion from the inner conducting portion;

d. connecting the source of current in a sealed and electrically isolated manner to the inner electrically conducting portion of the first tubing hanger or to the first tubing string, such that the one or more wellhead members are electrically isolated from the first tubing string; and e. connecting the source of current to the one or more wellhead body members so as to provide a grounding connection to the second tubing string.

Preferably, the one or more wellhead body members form first and second tubing hanger profiles to support the first and second tubing hangers in vertically stacked relationship in the vertical wellbore. Preferably, the inner conducting portion of the first tubing hanger includes a conducting neck portion extending upwardly relative to the outer housing of the first tubing hanger, and the source of current is connected to the conducting neck portion outside the vertical wellbore.

It should be understood that the terms "electrical connection" or "electrically connected" as used herein and in the claims is meant to cover both a direct or an indirect electrical connection between the identified members. Thus, for example when it is stated that an electrical connection is provided from the hot electrical connection to the conducting tubing string, the hot electrical connection may make a direct connection to the conducting tubing string, or the connection may be made indirectly through, for example, the conducting portion of the isolated tubing hanger.

It should also be understood that the terms "conductive" or "conducting" when used as adjectives herein and in the claims means that the material for the part modified by these terms is made of one or more electrically conducting materials. Similarly, the terms "grounding" or "grounded" when used as adjectives herein and in the claims means that the material for the part modified by these terms is made of one or more electrically conductive materials.

BRIEF DESCRIPTION OF THE DRAWINGS

FIGS. 5-10 provide six views of a second embodiment of the method and apparatus of this invention, using a rod and clamp assembly to make the electrical connection, in which:

FIG. 5 is a perspective view of the upper tubing head and the electrical feed through spool or clamp head, with the electrical connection being provided in the electrical feed through spool;

FIG. 6 is a top view of the electrical feed through spool and tubing head for the isolated tubing hanger;

FIG. 7 is a side section view of the electrical feed through spool and tubing head taken along line 7-7 of FIG. 6;

FIG. 8 is a side sectional view taken along line 8-8 of FIG. 6;

FIG. 9 is a side view of the electrical feed through spool and tubing head; and FIG. 10 is a top sectional view taken along line 10-10 of FIG. 9.

FIGS. 11-22 show a third embodiment of the invention using the rod and clamp connection similar to the second embodiment, but including more detail, and an alternate embodiment of the isolated tubing hanger, in which:

FIG. 11 is a side view, partially in section, showing the multiple wellhead body members, from top down including a tubing hanger adapter, electrical feed through spool, tubing head for the isolated tubing hanger, and grounding or neutral connection tubing head;

FIG. 12 is a side view of the electrical feed through spool for the hot electrical connection;

FIG. 13 is a top view of the electrical feed through spool showing the electrical clamp assembly in the vertical bore;

FIG. 14 is a side sectional view of the electrical feed through spool taken along line 14-14 of FIG. 13, showing the conductive rod, electrical clamp assembly and the electrical isolation assembly;

FIG. 15 is a perspective view of the electrical feed through spool showing the parts in exploded detail;

FIG. 16 is a perspective view of the electrical clamp assembly;

FIG. 17 is a side sectional view of the isolated tubing hanger, showing the conducting neck extension electrically isolated from the housing;

FIG. 18 is a perspective view of the isolated tubing hanger, showing the parts in exploded detail;

FIG. 19 is a perspective view of the grounding or neutral connection tubing head;

FIG. 20 is a side view, partially in section, of the grounding tubing head showing the profile for the neutral connection or grounding tubing hanger;

FIG. 21 is a side sectional view of the grounding tubing hanger; and

FIG. 22 is a side view, partially in section, of the neutral rod connection assembly.

FIGS. 24-26 relate to a fifth embodiment of the wellhead assembly of this invention, in which the hot and neutral connections are both made outside the vertical wellbore enclosed by the wellhead body members, preferably at the top of the wellhead, in which:

FIG. 24 is a perspective view showing the electrical junction box partially cut-away, mounted above the wellhead body members in order to provide both the hot connection to the isolated tubing hanger and the grounding connection to the grounding tubing hanger, with both connections being outside the wellhead body members.

FIG. 25 is a side view, partially in section, showing, in stacked relationship top to bottom below the electrical junction box, a tubing head adapter, a tubing head and a grounding connection tubing head, with the isolated tubing hanger located in the tubing head, and the grounding tubing hanger located in the grounding tubing head.

FIG. 26 is a side sectional view of only the tubing head adapter and tubing head wellhead members (electrical junction box removed), showing greater details for the isolated tubing hanger and its connection to a clamp assembly outside the wellhead.

DESCRIPTION OF THE PREFERRED EMBODIMENTS

Figure 1:
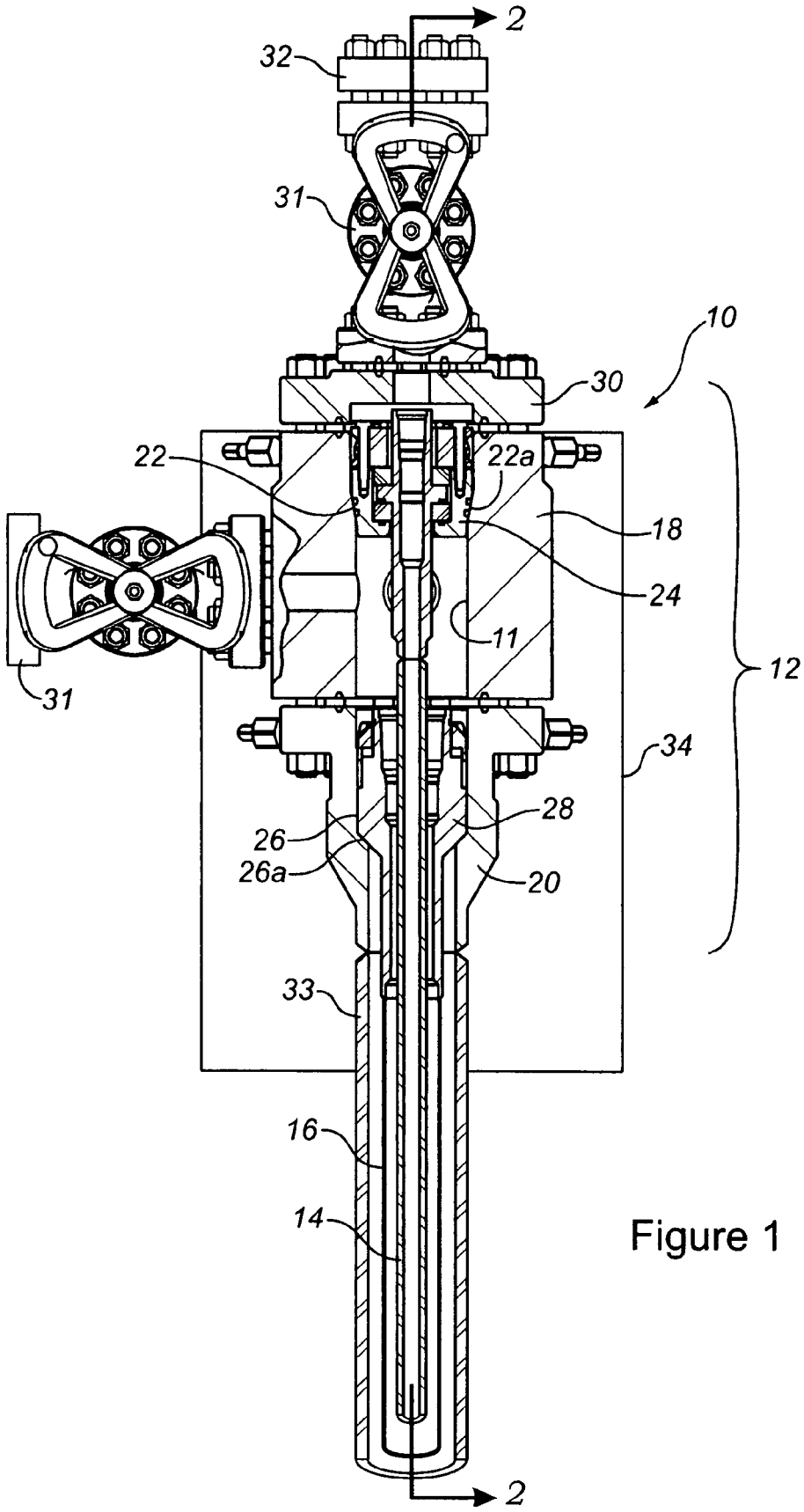
FIG. 1 shows a side view, partially in section, of one embodiment of the method and apparatus of this invention, using reciprocating horizontal rams to make the electrical connection in an upper tubing head, and using a grounding or neutral connection assembly therebelow, including a grounding or neutral tubing head, to make a ground connection.
Figure 2:
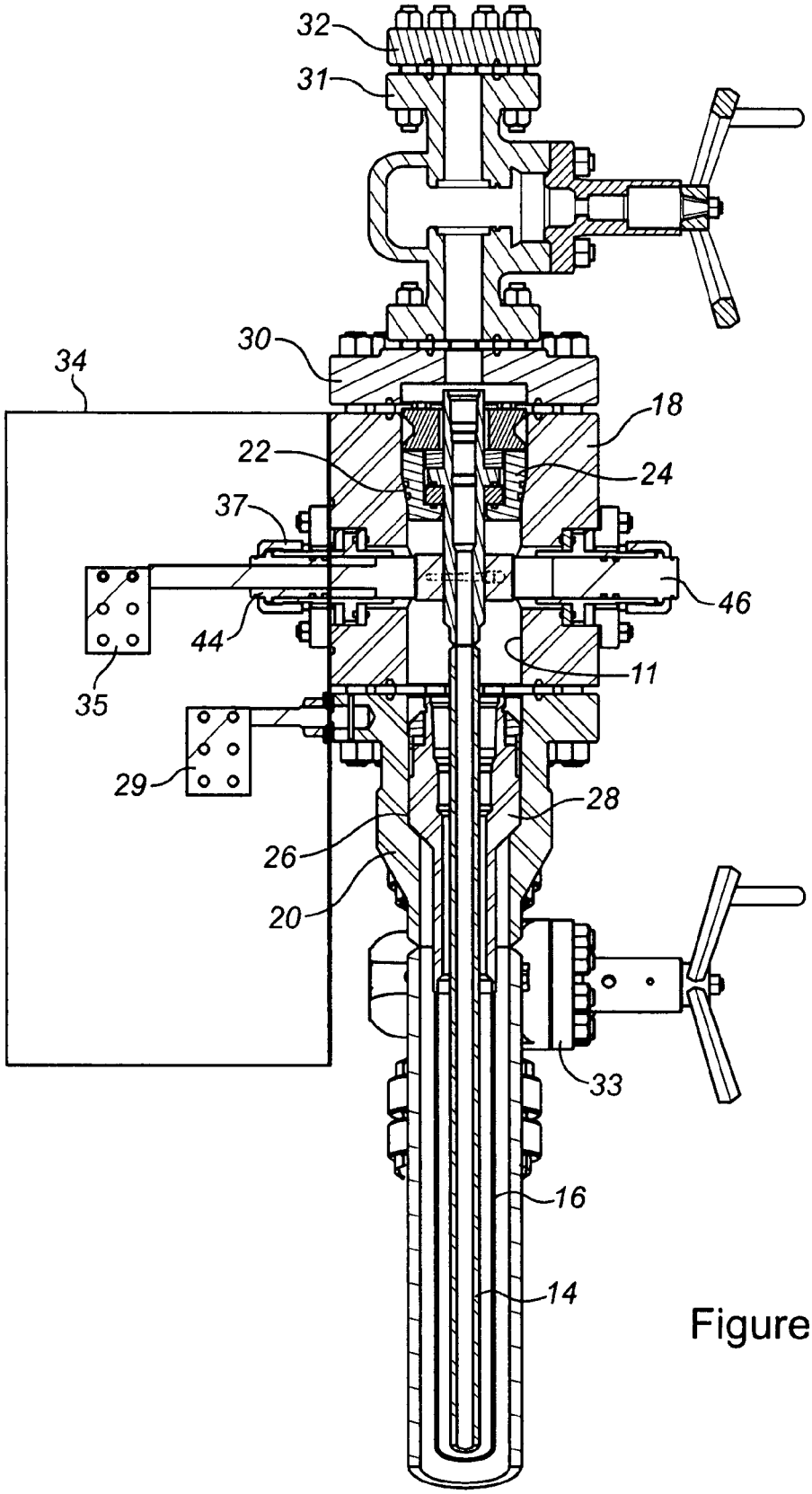
FIG. 2 is a side sectional view taken along line 2-2 of FIG. 1.
Figure 3:
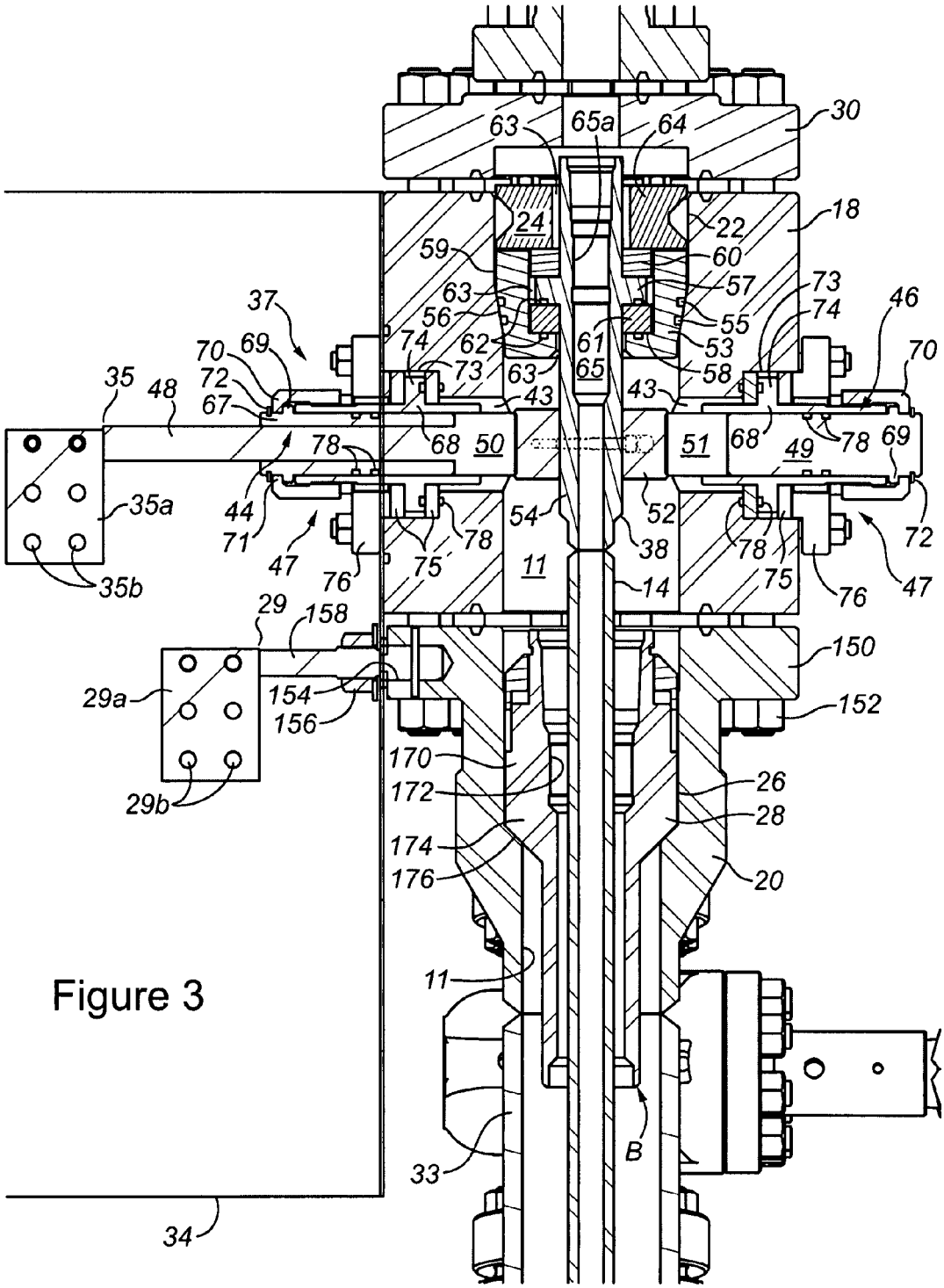
FIGS. 3 and 4 are partial side sectional views of FIGS. 1 and 2 respectively, showing a conducting ring fixed on the lower portion of the electrically isolated tubing hanger in order to make electrical contact to the conducting tubing string, and thus to make the electrical connection to the conducting ram assembly.
Figure 4:
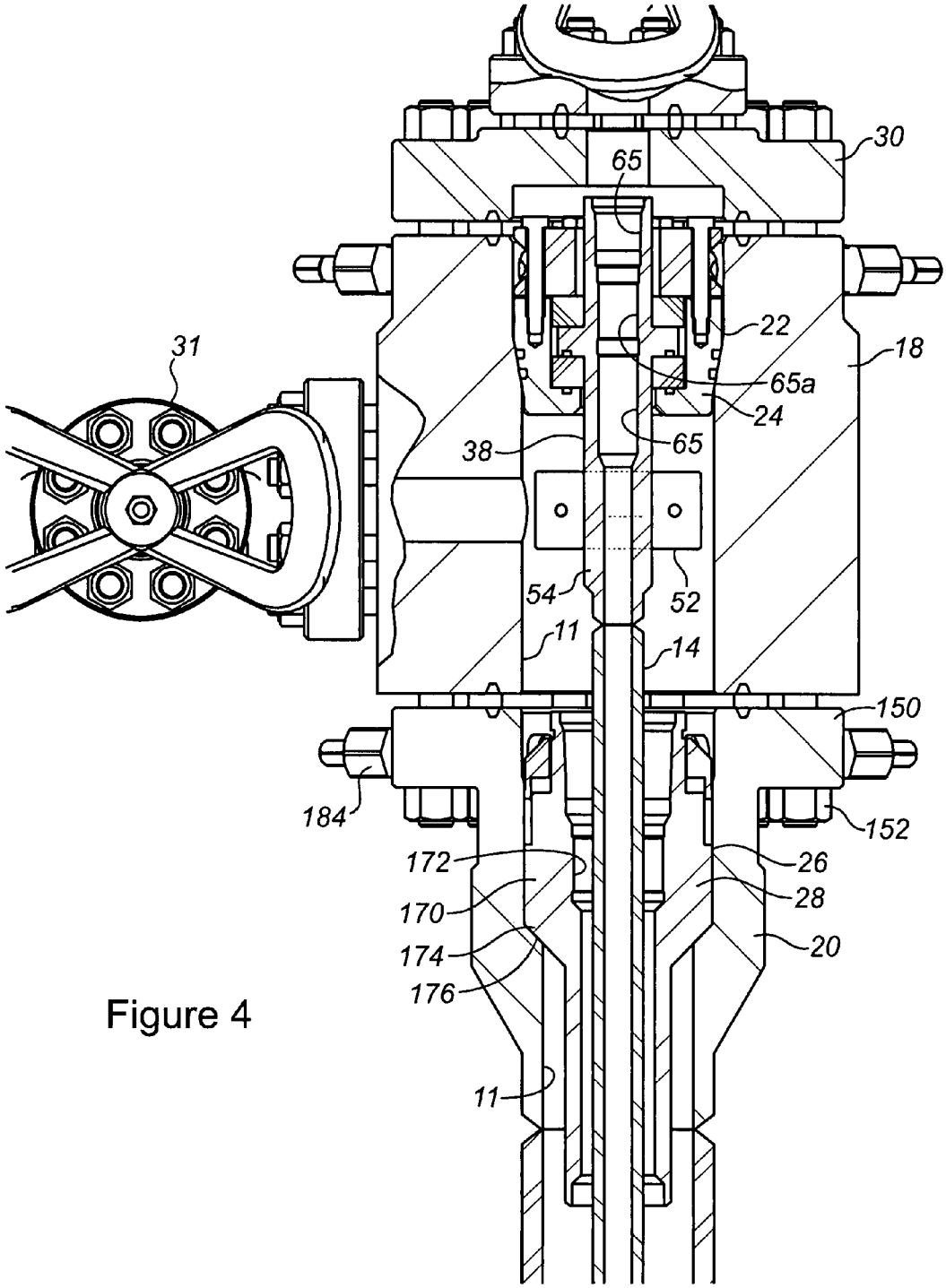
Figure 5:
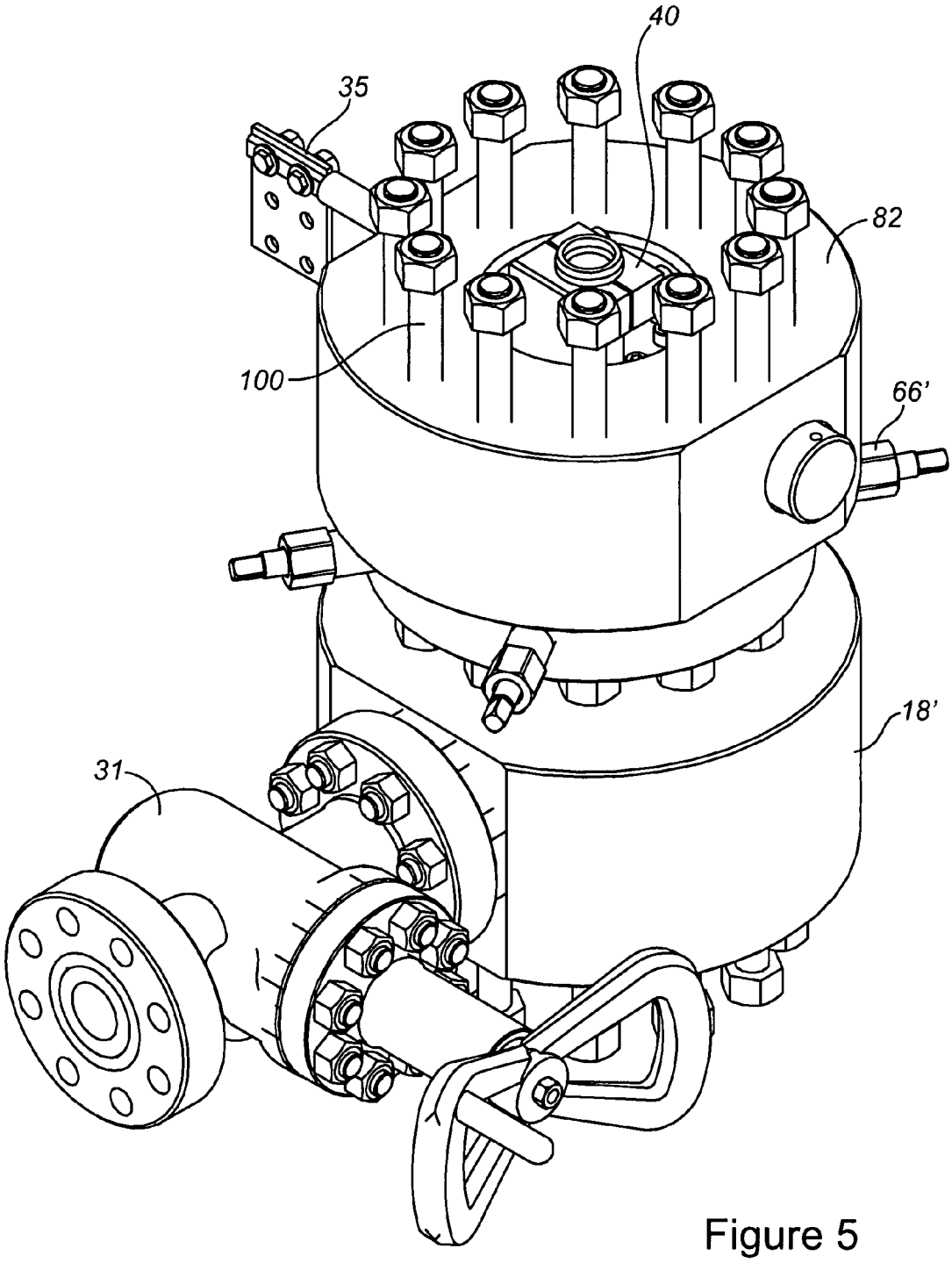
Figure 6:
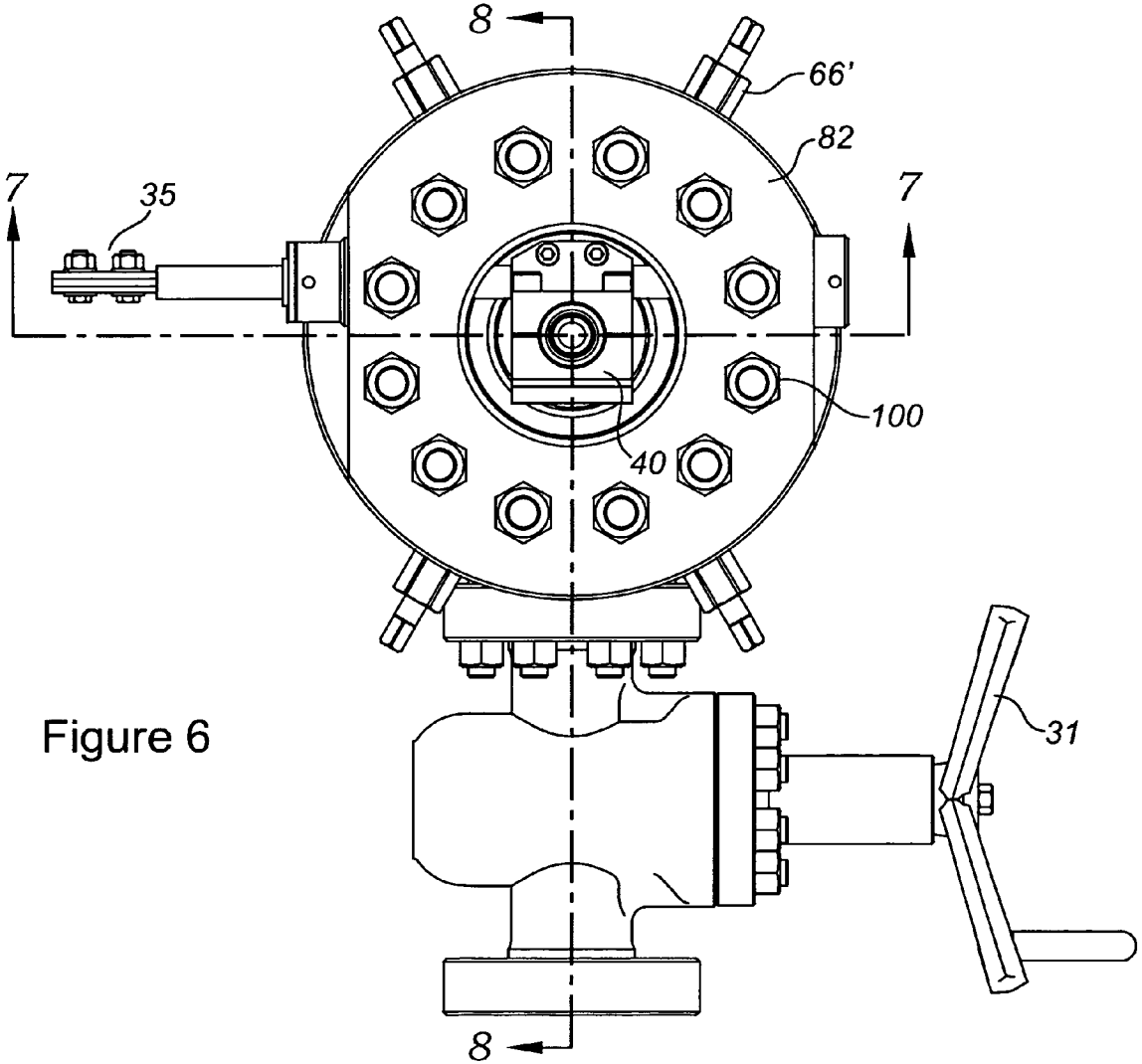
Figure 7:
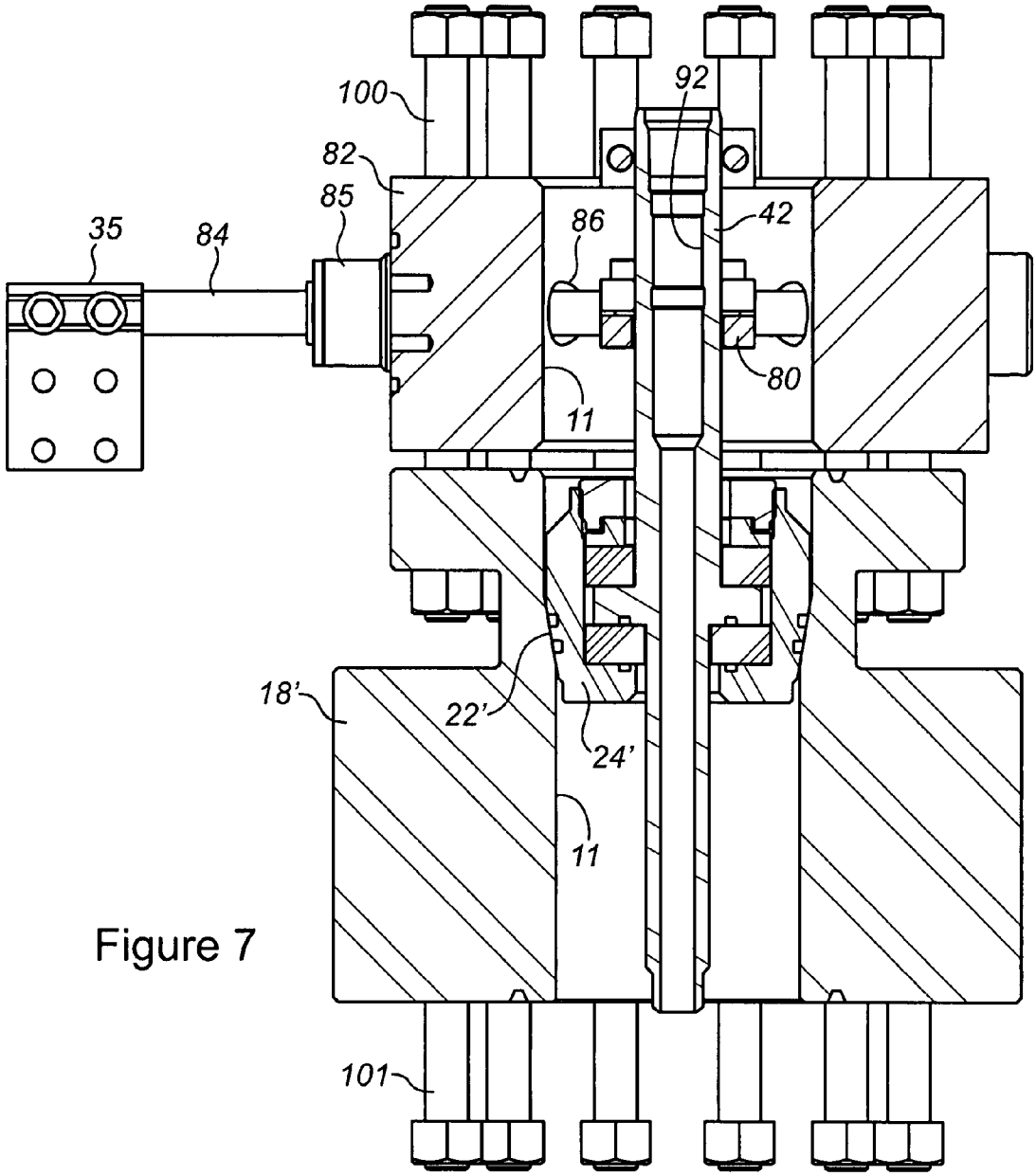

The present invention provides both a method and apparatus for providing electrical connection at a wellhead for a downhole electrical device, such as a heater. The invention has utility in providing the electrical connection through to tubular conductors (generally concentric tubing strings), which in turn are electrically connected to the downhole electrical device. Five embodiments of the present invention are shown in the Figures, with like members being labeled with the same reference numerals. Once an element has been introduced for the first embodiment, it is denoted with a prime, double prime or triple prime after the reference numeral for the other embodiments in order to signify that the element is modified or that it is included in a modified part of that embodiment.

In general, the wellhead power connection assembly 10 of the present invention is shown in the Figures to include one or more wellhead body members 12 (multiple wellhead body members are shown in the Figures, although it is possible to combine one or more of these wellhead members in some applications), operative to cap a wellbore which has been drilled into an oil formation and contain pressure in a vertical wellbore 11, which extends through each of the body members 12 and is generally vertically aligned. Thus, each of the one or more wellhead body members is formed from pressure-containing metal, with all connections (such as ring seals, preferably provided as ring gasket seals between body members) being pressure-containing. Two concentric tubing strings (one of which could be the casing, but referred to herein as tubings or tubing strings) formed of electrically conductive material(s) (for instance copper clad steel) are suspended by the one or more wellhead body members 12. The Figures show these tubing strings as an inner conducting tubing string 14 and an outer grounding tubing string 16, but they could be reversed. The tubing strings 14, 16, along with an electrical downhole apparatus (not shown) are run into the wellbore. The tubing strings 14, 16 are suspended concentrically in stacked tubing heads 18, 20 in the wellhead assembly 10, and are used to conduct electricity to the downhole electrical device. The uppermost tubing head 18 forms a tubing hanger profile 22 operative to support and seal to an isolated tubing hanger 24. The conducting tubing 14 is suspended, for example by welding, from the lower end of the tubing hanger 24, to provide power to the downhole electrical device (not shown). The lower tubing head 20 (also termed grounding or neutral tubing head) forms a tubing hanger profile 26 operative to support and seal to a grounding tubing hanger 28, which in turn suspends the grounding tubing 16 from its lower end, for example by welding. A ground or neutral connection assembly 29, consisting of a grounding plate 29*a* and nut and bolt connectors 29*b*, provides a ground connection from the current source for the grounding tubing head 20 proximate the grounding tubing hanger 26. The circuit is completed through the downhole electrical device. Alternate means for suspending the tubing strings 14, 16 from tubing hangers 24, 28 are known, and may be used within this invention, for example threaded, welded or slip connections. The preferred embodiments show the tubing hangers 24, 28, and the tubing hanger profiles 22, 26 to be generally cylindrical, with inwardly tapered sections to provide mating landing shoulders 22*a*, 26*a*, in order to support the tubing hangers 24, 28 within the tubing heads 18, 20. However, other profile shapes may be used, as is well known in the art. The tubing strings 14, 16 may also be otherwise suspended from one or more wellhead members 12, as well known in the art. For instance nested tubing hangers might be suspended from a wellhead. The tubing head could be altered to include a run-in landing shoulder. Still alternatively, the tubing head might include retractable load shoulders. Other variations within the invention will be well known to persons skilled in the art.

The wellhead assembly 10 is shown to preferably include a tubing head adapter 30 as a transition body member to the conventional wellhead equipment located thereabove (shown as a conventional gate valve 31 and a blind flange 32 in the FIGS. 1-23). The tubing head adapter 30 also functions to form extra spacing in its vertical bore 11 above the isolated tubing hanger 24, to assist in electrical isolation. As well, the tubing head adapter 30 provides another pressure-containing wellhead member above the tubing hanger 24. The tubing head adapter 30 may be omitted in some applications. The grounding tubing head 20 connects at its lower end to conventional wellhead equipment such as surface casing or valve equipment, shown generally as 33 in the Figures. Additional conventional gate valve 31 is shown with the tubing head 18 in order to close off the vertical bore 11.

Figure 24:
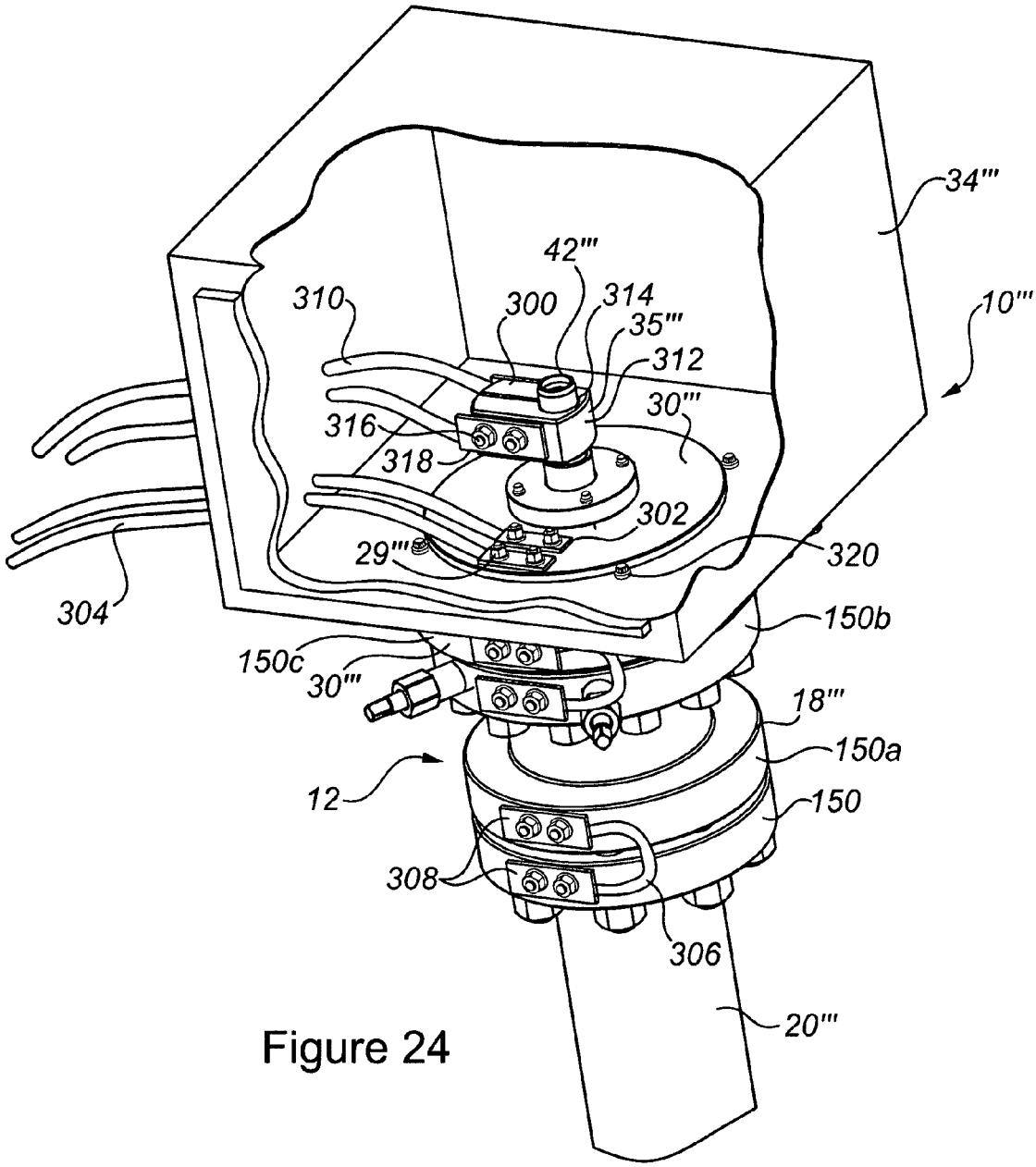
Figure 25:
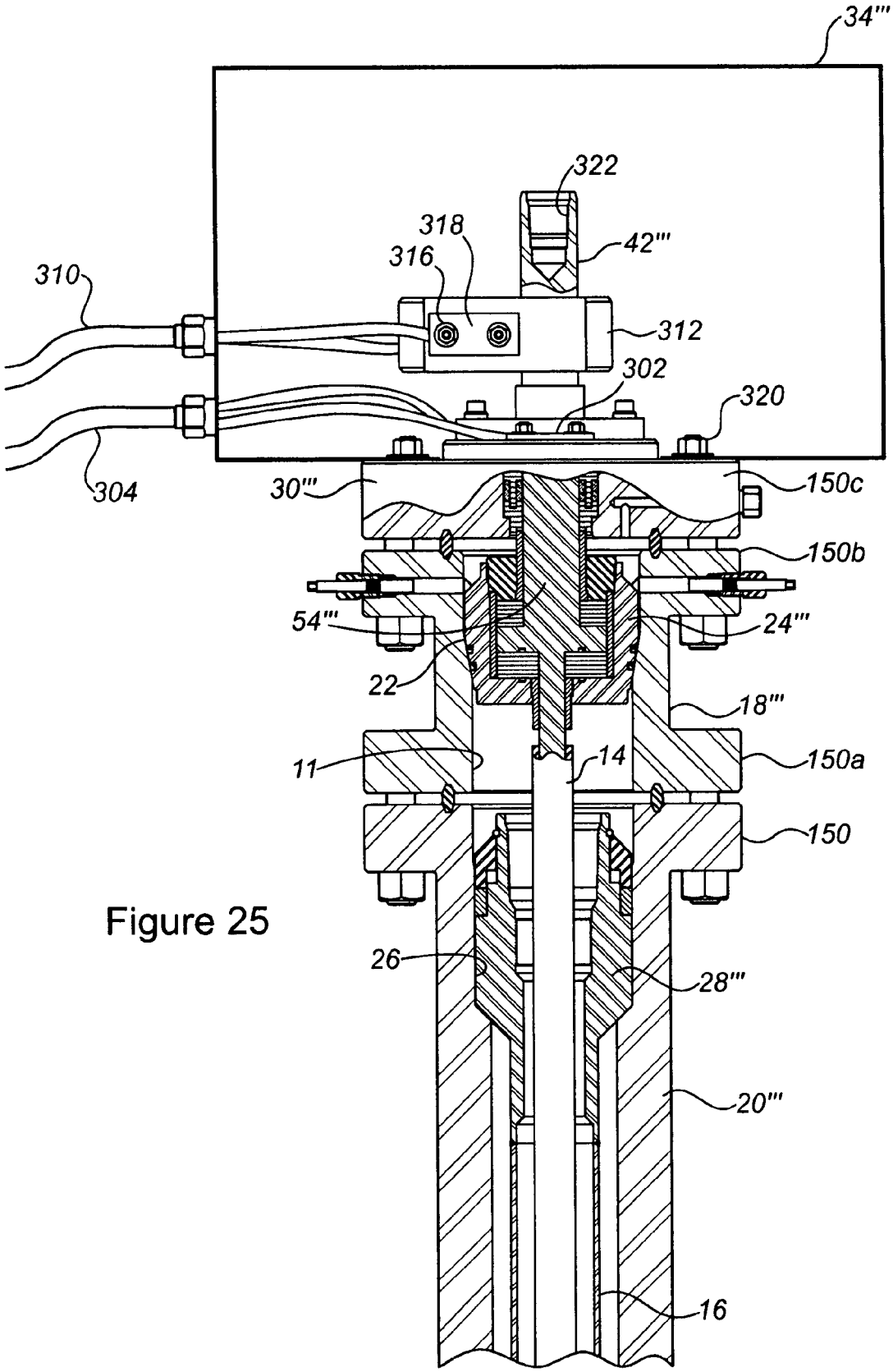
Figure 26:
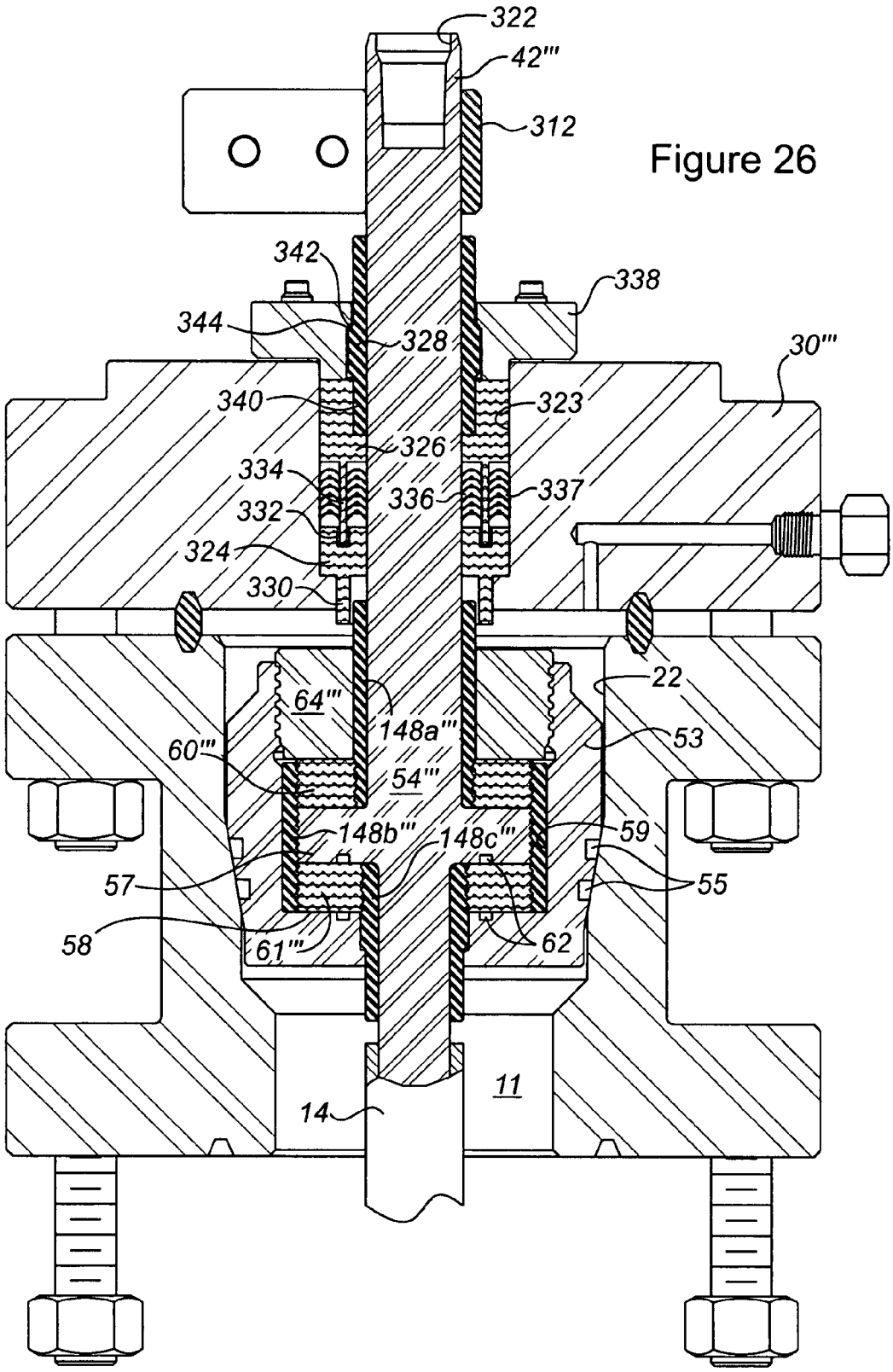

An electrical junction box 34 is mounted to, or alongside, the wellhead body member(s) 12. In FIGS. 1-23, the electrical junction box 34 is mounted beside the body members 12 for ease of electrical connection through to the conducting tubing string 14 (i.e., through the wellhead). In FIGS. 24-26, the electrical junction box 34''' is mounted above the wellhead members 12 for electrical connection in a more direct manner outside the wellhead to the isolated tubing hanger 24'''. The grounding connections 29 and 29''' of the embodiments are made to the wellhead members 12 as appropriate, but is most conveniently done in the same electrical junction box. Thus, in FIGS. 1-23, the grounding connection 29 is preferably made proximate the grounding tubing head 20. In FIGS. 24-26, the grounding connection 29''' is preferably made to the uppermost wellhead member, the tubing head adapter 30.

In FIGS. 1-23, a power source (not shown, but any phase power supply may be used) provides a source of current with a first connection to a hot electrical connection assembly 35, including a connection plate 35*a* and nut and bolt connectors 35*b*, proximate the tubing head 18 and a second connection to the ground or neutral connection assembly 29 preferably proximate the grounding or neutral tubing head 20. The ground connection assembly 29 includes a connection plate 29*a* and nut and bolt connectors 29*b*.

In FIGS. 24-26, the hot electrical connection assembly 35''' is simplified to clamp directly onto the isolated tubing hanger 24''' above the wellhead members 12 (i.e., outside the wellhead). The ground connection assembly 29''' is also simplified to connect directly to a wellhead body member 12, in this case to the uppermost member, the tubing head adapter 30.

The present invention provides methods and apparatus for providing an electrical connection through the wellhead to provide electricity to the downhole electrical device. In its preferred embodiments of FIGS. 1-23, as described herein, the unique design of the electrical connection allows for mechanical disengagement of the electrical connection while the wellhead and wellbore are under pressure. The embodiments of FIGS. 24-26 exemplify a simplified electrical connection outside the wellhead members.

In general, components of the present invention provide seals or are made of materials capable of providing high pressure, high voltage, and high current isolation at elevated temperatures, particularly for operation in conditions needed for electrical heating of a heavy oil reservoir. To limit eddy currents, certain components of the assembly 10 may be made from non-ferromagnetic materials. Electrically isolating materials used in the isolated tubing hanger 24 and the electrical isolation assembly 47 associated therewith, may be made from known electrically insulating materials, for example Teflon® (where not load bearing), and PEEK (polyetherethylketone) when load bearing. Alternate insulating materials such as NEMA Grade 7 through Grade 11 materials and others may be used, as known in the art.

In the first and fourth embodiments shown in the FIGS. 1-4, and FIG. 23 described hereinbelow, the electrical connection is made through a ram assembly 37, to a downwardly extending conducting neck extension 38 of the isolated tubing hanger 24 (i.e., located below the tubing hanger profile 22). In the second and third embodiments (FIGS. 5-10 and 11-22), electrical connection is made through a rod and clamp connection assembly 40, to an upwardly extending conducting neck extension 42 (or 42") of the isolated tubing hanger 24' (or 24") (i.e., located above the tubing hanger profile 22). In the fifth embodiment (FIGS. 24-26), electrical connection is made through a clamp connection assembly 300, to an upwardly extending conducting neck extension 42''' of the isolated tubing hanger 24'''. The ground or neutral connection assembly 29 and associated grounding or neutral tubing head equipment, being common to the first four embodiments is described in detail in association with the third embodiment. For the fifth embodiment, the ground or neutral connection assembly 29''' is separately described, however the grounding tubing head 20 and grounding tubing hanger 28 are otherwise identical to that described for the third embodiment. In all of the embodiments shown, the electrical connection is made to a conducting portion of the isolated tubing hanger 24, 24', 24" or 24'''. However, it should be appreciated that the electrical connection may be made directly to the conducting tubing 14 by the ram assembly 37, within the scope of the present invention.

First Embodiment—Ram Connection, FIGS. 1-4

The ram assembly 37 is sealed and electrically isolated in a horizontal conduit 43 in the tubing head 18. The conduit 43 is located to provide access through the tubing head 18 to the vertical bore 11 at a point to provide electrical connection either directly to the conducting tubing 14, or more preferably, to a conductive portion of the isolated tubing hanger 24, such as the conducting neck extension 38 of the tubing hanger 24, as shown in the figures. The ram assembly 37 is shown to preferably include two ram assemblies, a conducting ram assembly 44 and a supporting ram assembly 46, located in the tubing head 18. The interface between the ram assemblies 44, 46 and the tubing head 18 is pressure sealed and electrically isolated through an electrical isolation assembly 47. The conducting actuation rod 48 and conducting ram 50 of the conducting ram assembly 44 are formed of an electrically conductive material such as copper, with one end of the rod 48 being connected to a source of current through the hot electrical connection assembly 35. The supporting ram assembly likewise includes a support ram 51 connected to a support actuation rod 49. The rams 50, 51 in each ram assembly 44, 46 move horizontally in and out of the vertical wellhead bore 11 of the tubing head 18. When fully protruding into the vertical wellhead bore 11 (see FIG. 3) the rams 50, 51 preferably contact a conducting ring 52 fixed to the conducting neck extension 38 of the electrically isolated tubing hanger 24, which in turn is in direct electrical contact with the conducting tubing 14 (welded). The ring 52 is formed of an electrically conductive material such as copper, and may be bolted to the neck extension 38. The ring 52 increases the diameter of electrical contact area and reduces the required travel of the rams 50, 51. The heads of the rams 50, 51 are preferably concave in shape to maximize the electrical surface area for contact with the ring 52. The conducting ram assembly 44 conducts electricity into the hanger 24 and tubing 14 (through the conductive rod 48 and the ram 50 connected to the rod 48), while the supporting ram assembly 46 stabilizes the neck extension 42 of the tubing hanger 24. When the rams 50, 51 are fully retracted from the wellbore 11, the electrical connection is broken and full bore access from the top of the wellhead is achieved. The rams 50, 51 can thus be operated while the wellhead is under pressure. There is no need to remove electrical equipment to gain access to the hanger 24 or the wellbore 11, the electrical connection can simply be broken with this ram assembly design.

The isolated tubing hanger 24 is formed with an outer, generally cylindrical housing 53 (which remains electrically isolated), and an inner, generally cylindrical landing coupling 54 which provides electrical contact between the rams 50 and the conducting tubing 14. O-ring seals 55 on the external circumference of the outer housing 53 seal the hanger 24 within a circumferential seat or shoulder 56 in the profile 22 for the isolated tubing hanger 24. The landing coupling 54 includes a widened diameter, circumferential landing shoulder 57 which seats on an inwardly extending circumferential landing seat 58 in the central bore 59 of the tubing hanger 24. The downwardly extending neck extension 38 is formed at the lower end of the landing coupling 54 and extends below the profile 22 for the tubing hanger 24. The conducting tubing 14 is suspended from the lower end of the neck extension 38, for example by welding, with the conducting ring 52 being bolted to the neck extension 38 at a location to align with the rams 50, 51. The landing coupling 54 is electrically isolated from the outer housing 53 by a pair of upper and lower electrical insulation plates 60, 61 made of an electrical insulation material which is load bearing such as PEEK, located above and below the landing shoulder 57 of the coupling 54. O-ring seals 62 above and below the lower insulation plate 61 seal the landing coupling 54 with the central bore 59 of the hanger housing 53. Spacing 63 or insulation are also provided between the housing 53 and the landing coupling 54 (see FIGS. 3 and 4). The hanger parts are energized and retained by a retainer ring 64 which is bolted into the top of the housing 53 (see FIG. 4). The landing coupling 54 preferably has a threaded portion 65*a* in its central bore 65 for a back pressure valve (not shown), which may be a one way or two way valve, as appropriate for the particular application. Sealed hanger lockscrews 66 protrude through the tubing head 18 to the isolated tubing hanger 24 in order to lock the isolated tubing hanger 24 against upward movement. In FIGS. 1-4, these lockscrews engage the retainer ring 64, but other embodiments to retain the tubing hanger 24 will be well known to those skilled in the art, some of which are shown in the other embodiments of the present invention.

The electrical isolation assembly 47 for the ram assemblies 44, 46 achieves electrical isolation of the isolation tubing head 18, while sealing the assemblies 44, 46 and allowing for horizontal reciprocating movement of the rams 50, 51. On the conducting ram side, the assembly 47 includes an electrically conductive actuation sleeve 67, fixed for example by welding, around the conducting actuation rod 48 and extending out of the tubing head 18. The actuation sleeve 67 is surrounded by an electrically conductive, static ram housing 68. An outer ring 69 fixed to or integral with the end of the actuation sleeve 67 opposite the ram 50, provides a widened diameter portion of the actuation sleeve 67. An actuation nut 70 is threaded onto the end of the housing 68 protruding from the tubing head 18. An inwardly extending lip 71 of the actuation nut 70 is positioned to contact the outer ring 69 of the actuation sleeve 67, such that rotation of the nut 70 pushes the sleeve 67 and thus the ram 50 into the wellbore 11 against the conducting ring 52. A ring 72 fixed to the end of the actuation sleeve 67 provides a shoulder for contact with the lip 71 of the actuation nut 70 such that on disengaging of the threads on the actuation nut 70, the actuation sleeve 67 and thus the ram 50 is retracted from the wellbore 11 to break the electrical contact. The horizontal conduit 43 includes a widened portion forming a circumferential seal pocket 73 at the outer wall of the tubing head 18. An outwardly extending sealing shoulder 74 fixed to or integral with the ram housing 68 seals in this seal pocket 73. Isolation sleeves 75, formed of an electrically isolating material of sufficient strength to handle the actuation and pressure loads (for example PEEK) are located on either side of the sealing shoulder 74 in the seal pocket 73. A retainer ring 76 is bolted to the outer wall of the tubing head 18 to retain and seal the ram assembly 44 within the conduit 43. O-ring seals 78 located around the inner of the isolation sleeves 75 provide a seal between the tubing head 18 and the ram housing 68. Similarly, O-ring seals 78 located between the actuation sleeve 67 and the ram housing 68 seal the actuation sleeve 67 within the housing 68. Spacing around the ram housing 68 and the wall of the horizontal bore 43 provide electrical isolation. Certain parts of the electrical isolation assembly, including sleeve 67, housing 68, nut 70 and rings 69 and 72 are preferably made of non-magnetic materials. Similar parts are included on the support ram side of the electrical isolation assembly to electrically isolate, seal and actuate the support ram 51 and support rod 49 in the conduit 43, except that the actuation sleeve and support actuation rod are combined in a single part labeled as 49.

The ground connection and grounding tubing head equipment for this embodiment is as described below for the third embodiment (sometimes termed neutral connection and neutral connection tubing head, but otherwise the same).

Second Embodiment—Rod and Clamp Connection, FIGS. 5-10

The rod and clamp connection assembly 40 provides a hot connection through to the conducting tubing 14 as for the first embodiment, but is preferably housed in a separate electric feed through spool 82 (also termed clamp head) connected above a tubing head 18'. The tubing head 18' is similar in function to tubing head 18 of the first embodiment, in providing a tubing hanger profile 22' for suspending an isolated tubing hanger 24'. However, whereas the first embodiment has provision in the tubing head 18 for the ram assembly 37 to make the electrical connection, this function is now provided by the electric feed through spool 82 of the second embodiment. As well, the isolated tubing hanger 24' differs from that in the first embodiment, by providing an upwardly extending conducting neck extension 42, for connection to the rod and clamp connection assembly 40. Other aspects of these parts 18' and 24' which are shared with the first embodiment, are commonly labeled in FIGS. 5-10, and are not further described herein.

Figure 8:
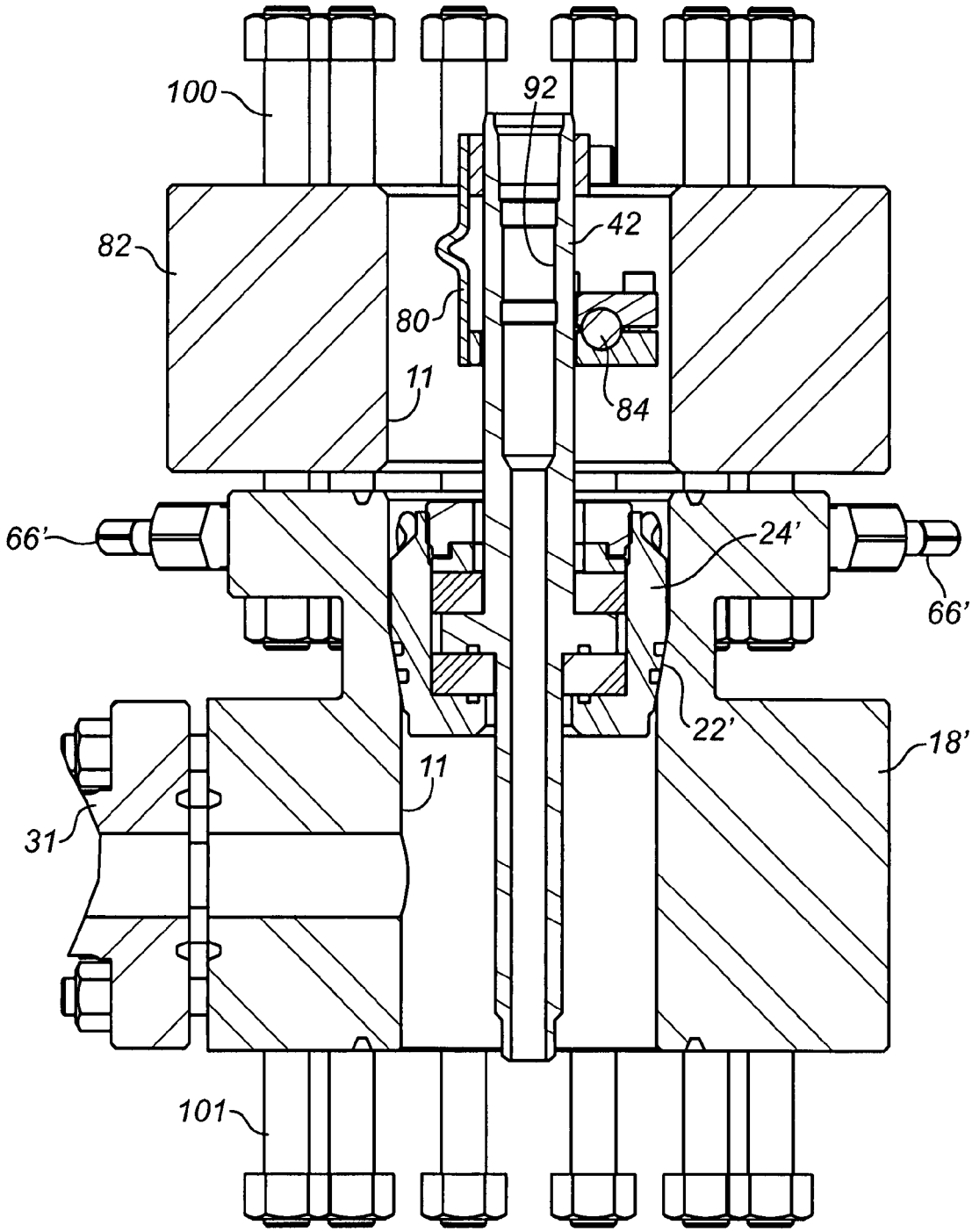
Figure 9:
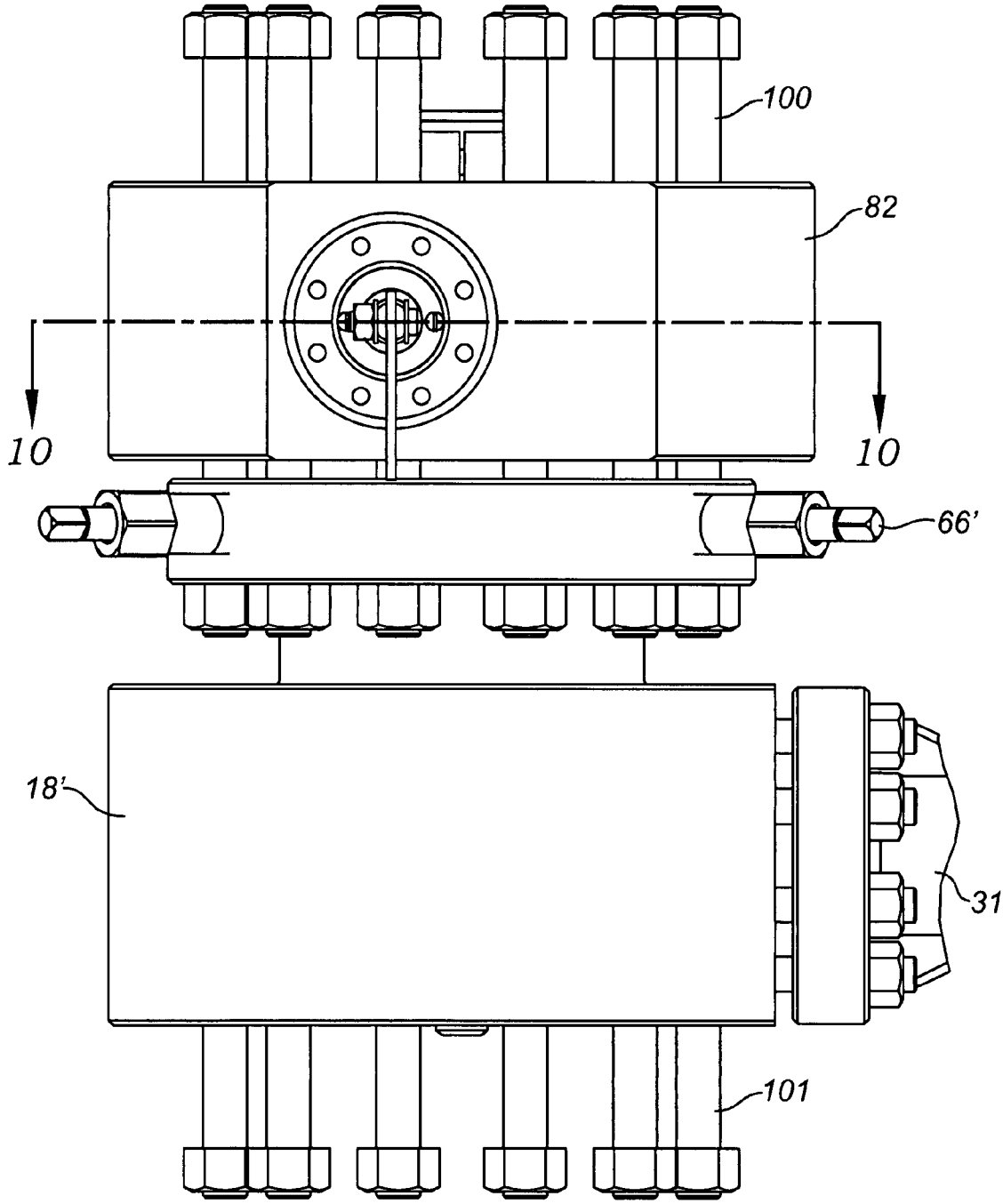
Figure 10:
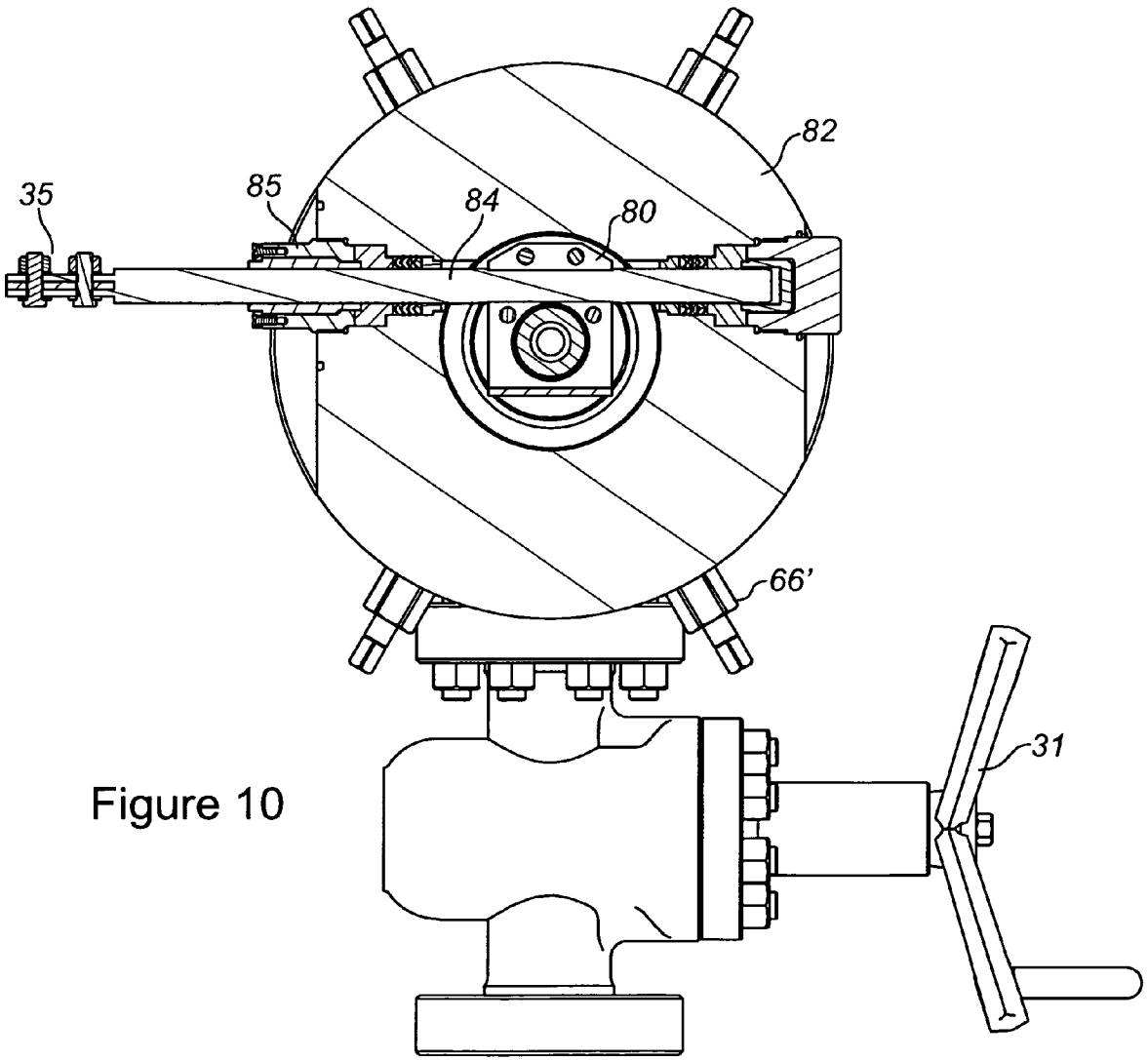

The rod and clamp assembly 40 provides a clamp assembly 80 inside the vertical bore 11 of the electrical feed through spool 82. A horizontal conductive rod 84 protrudes into the vertical bore 11 of the electrical feed through spool 82 and is clamped by the clamp assembly 80. The conductive rod 84 is pressure sealed and electrically isolated at each end by an electrical isolation assembly 85 within a horizontal conduit 86 which extends through the electrical feed through spool 82 to the vertical bore 11, more fully described below for the third embodiment. It is possible for the conductive rod 84 to end at the clamp assembly 80, but it is more preferably pressure balanced by extending across the vertical bore 11 with pressure sealing around both ends by the isolation assembly 85. The conductive rod 84 protrudes out one side of the electrical feed through spool 82 for connection to the hot electrical connection assembly 35. The clamp assembly 80 is mechanically attached (clamped) to the conductive rod 84 protruding into the vertical bore 11 of the electrical feed through spool 82. When in place, the clamp assembly 80 is positioned above the electrically isolated tubing hanger 24' around the tubing hanger neck extension 42 which extends into the electrical feed through spool 82 (FIG. 8). The clamp assembly 80 is pre-assembled onto the conductive rod 84, such that the tubing hanger neck extension 42 will be parallel to the vertical bore 11 of the electrical feed through spool 82. The electrical feed through spool 82 can then be lowered over the tubing hanger neck extension 42, with the neck extension 42 protruding through the tubing hanger neck extension bore 88 of the clamp assembly 80. The electrical feed through spool 82 can then be bolted to the tubing head 18 and the clamp assembly 80 can be tightened onto the tubing hanger neck extension 42. The clamp assembly 80, when in place in the wellhead, provides a mechanical and electrical connection between the conductive rod 84 and the isolated tubing hanger 24 and conducting tubing 14. The clamp assembly 80 is made of an electrically conductive material such as copper to reduce resistivity in the electrical circuit.

The tubing hanger neck extension 42 preferably contains a back pressure valve thread and profile 92. Pressure can then be contained inside the conducting tubing 14 when a back pressure valve (not shown) is installed in the tubing hanger neck extension 42. This allows the electrical feed through spool 82 and clamp assembly 80 to be installed or removed while the conducting tubing 14 is under pressure.

Third Embodiment—Rod and Clamp Connection, FIGS. 11-22

A further embodiment of the clamp connection is shown in FIGS. 11-22. This embodiment shows an alternate embodiment of an isolated tubing hanger 24", and greater details for the electrical isolation assembly 85 (common to second and third embodiments) and the ground or neutral connection (common to all embodiments). Like parts are labeled with the same numbers for ease of comparison.

Wellhead Body Members

Figure 11:
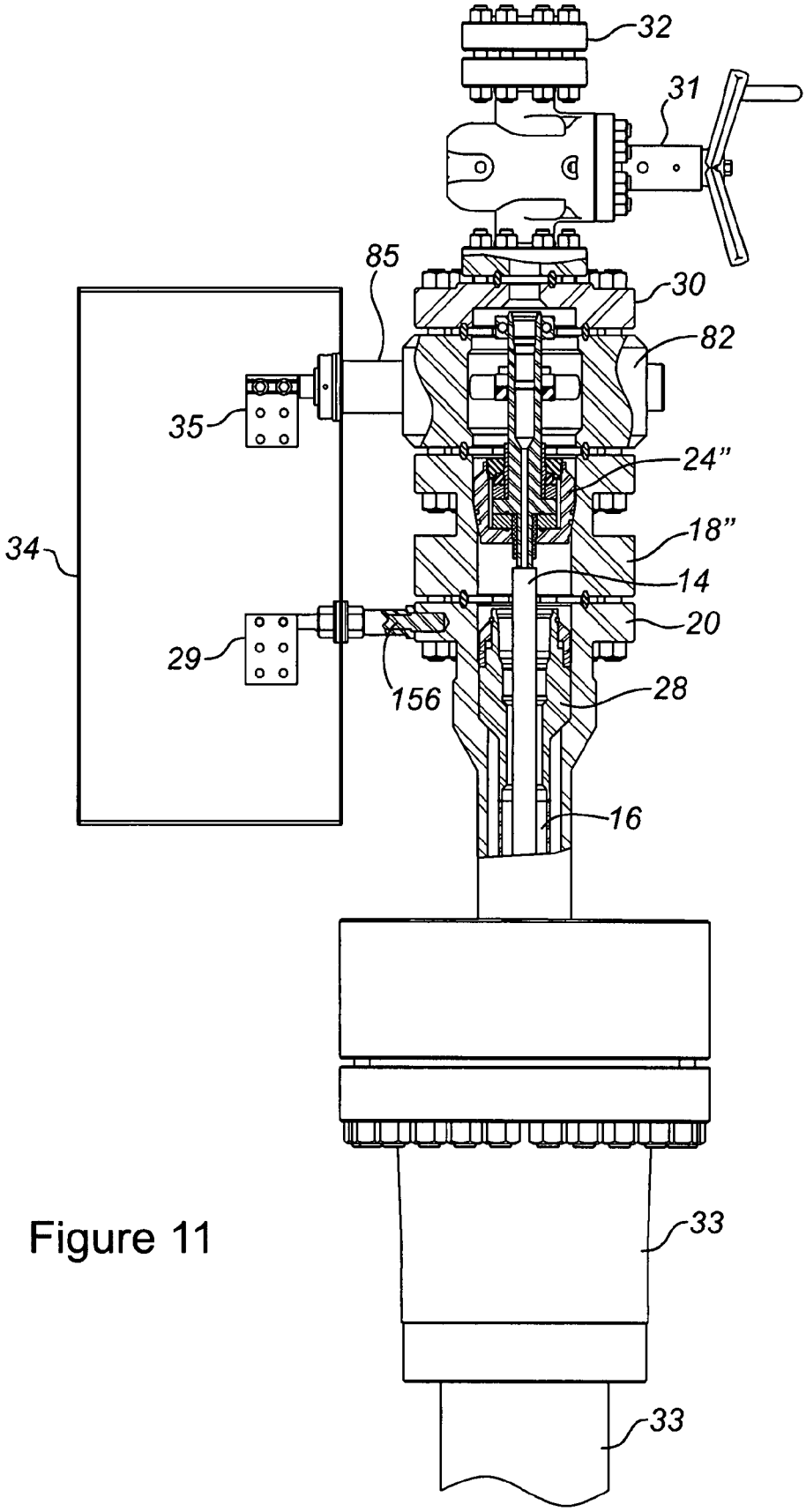
Figure 12:
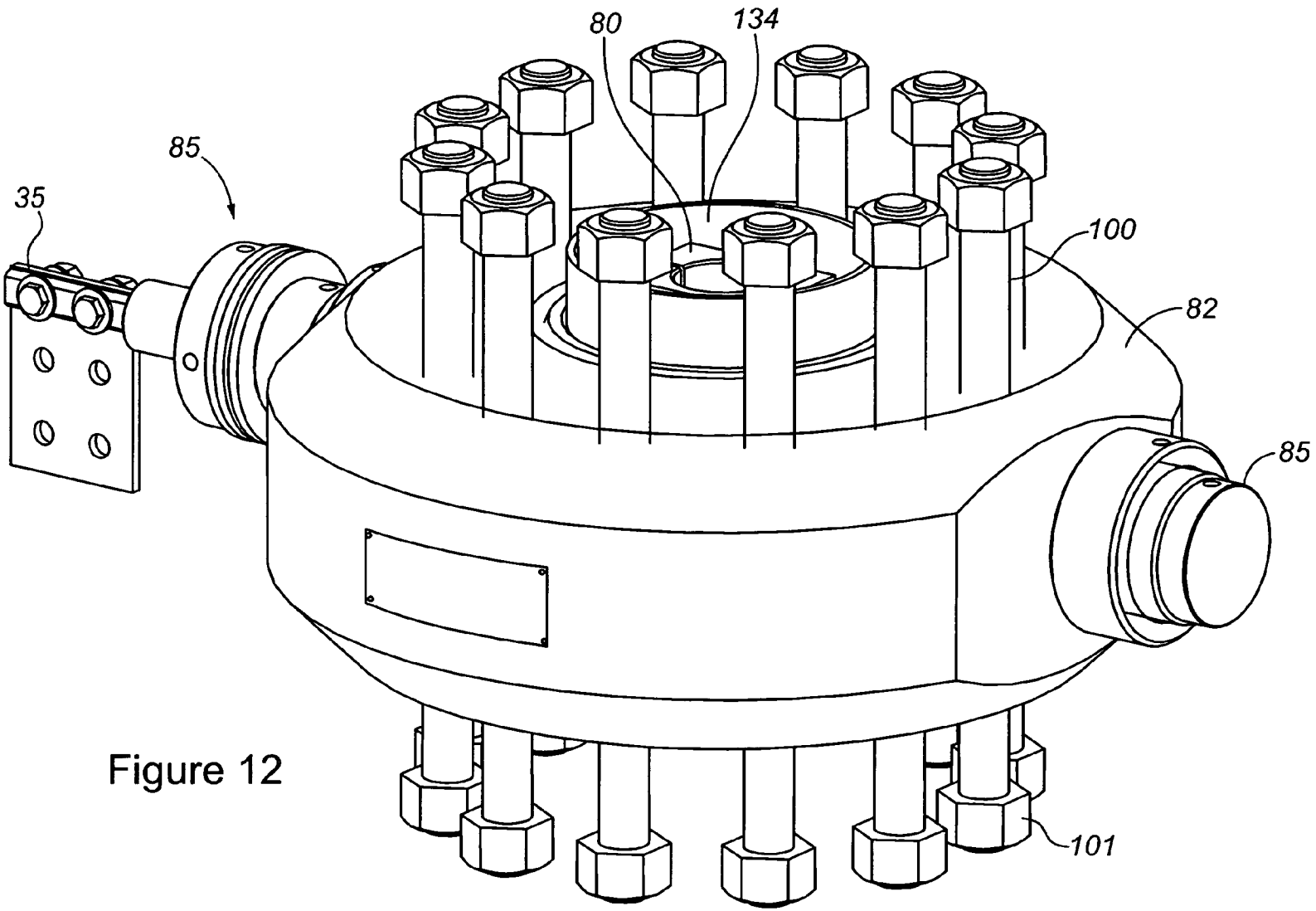
Figure 13:
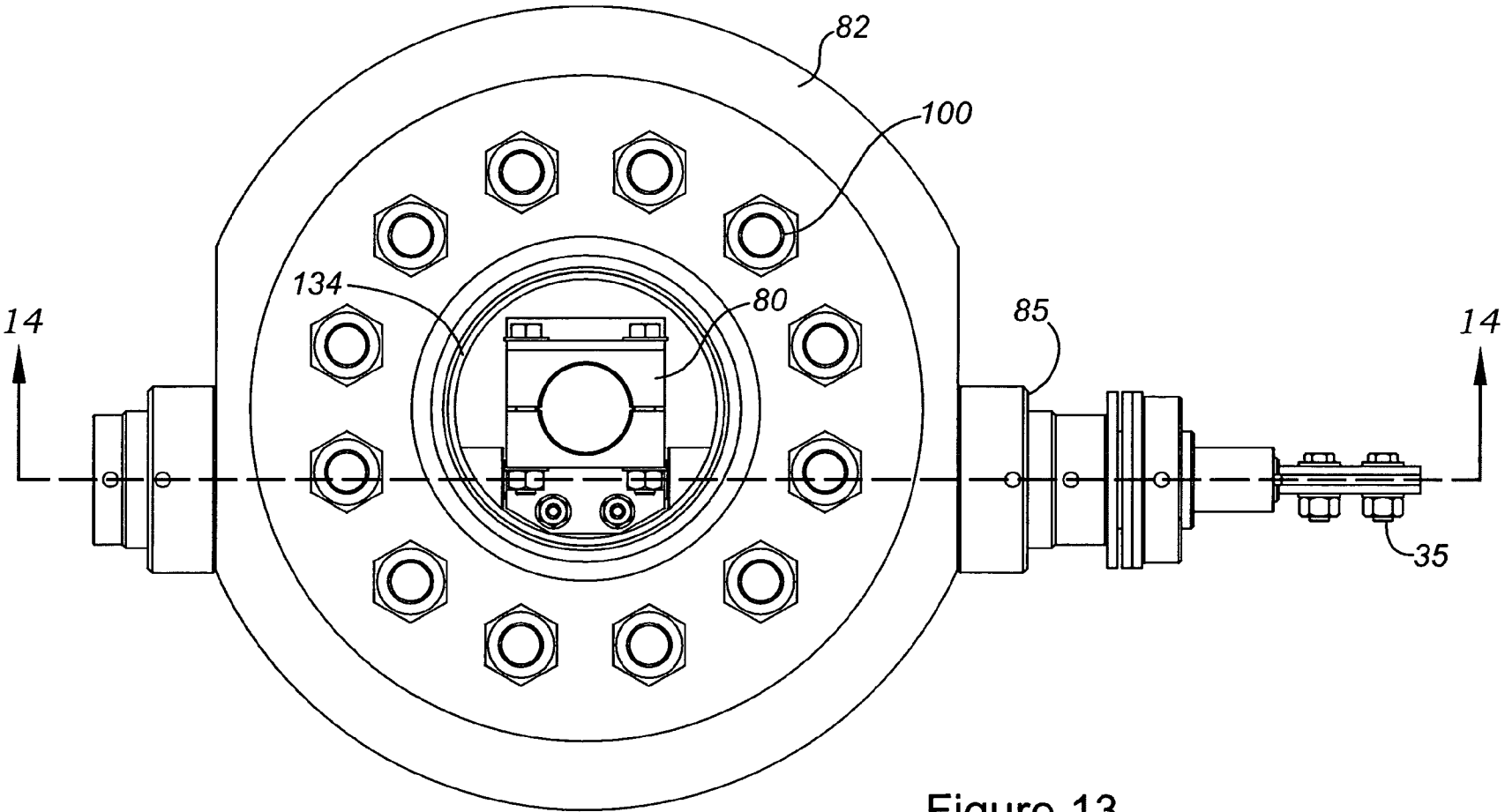
Figure 14:
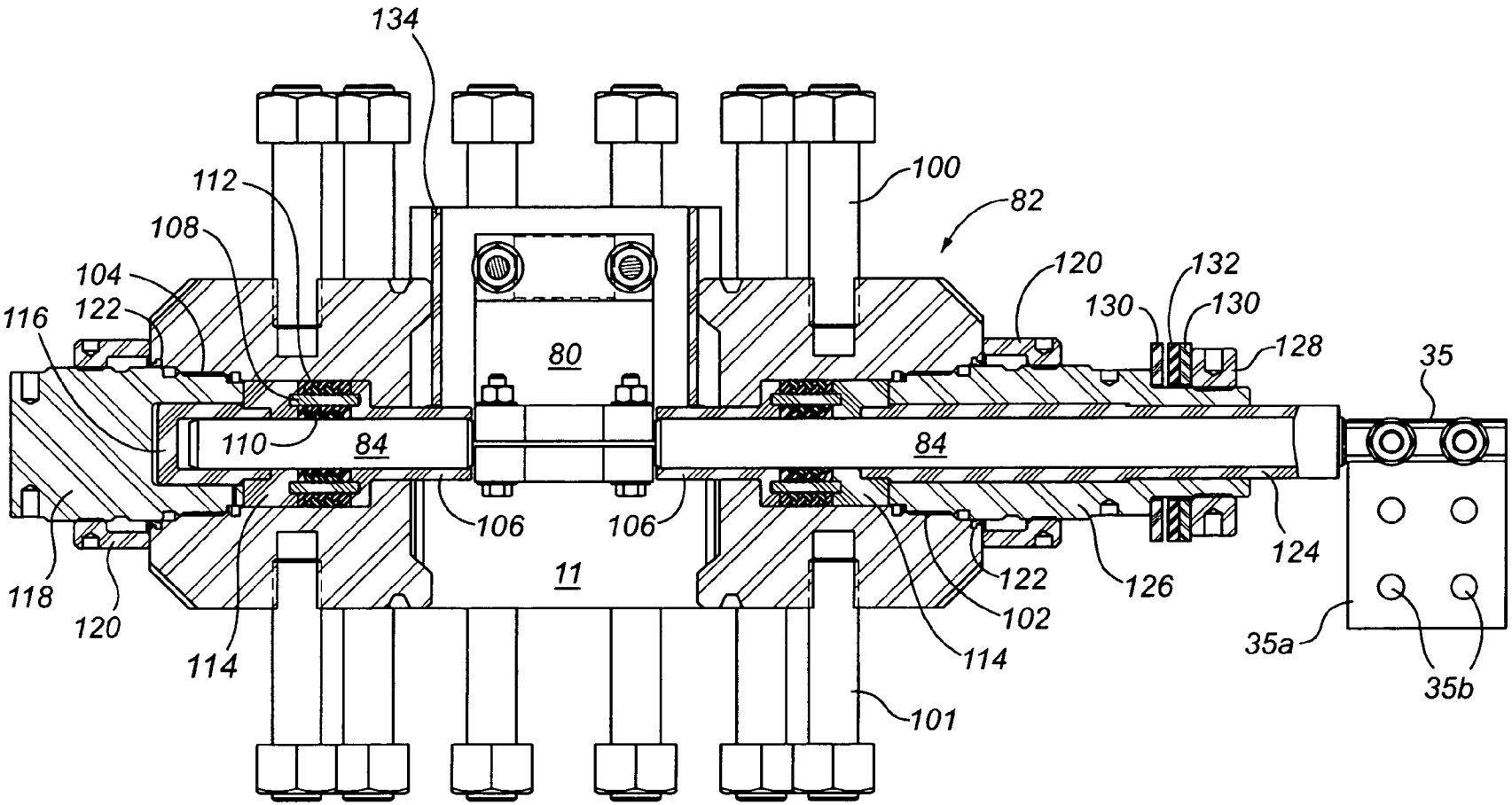
Figure 15:
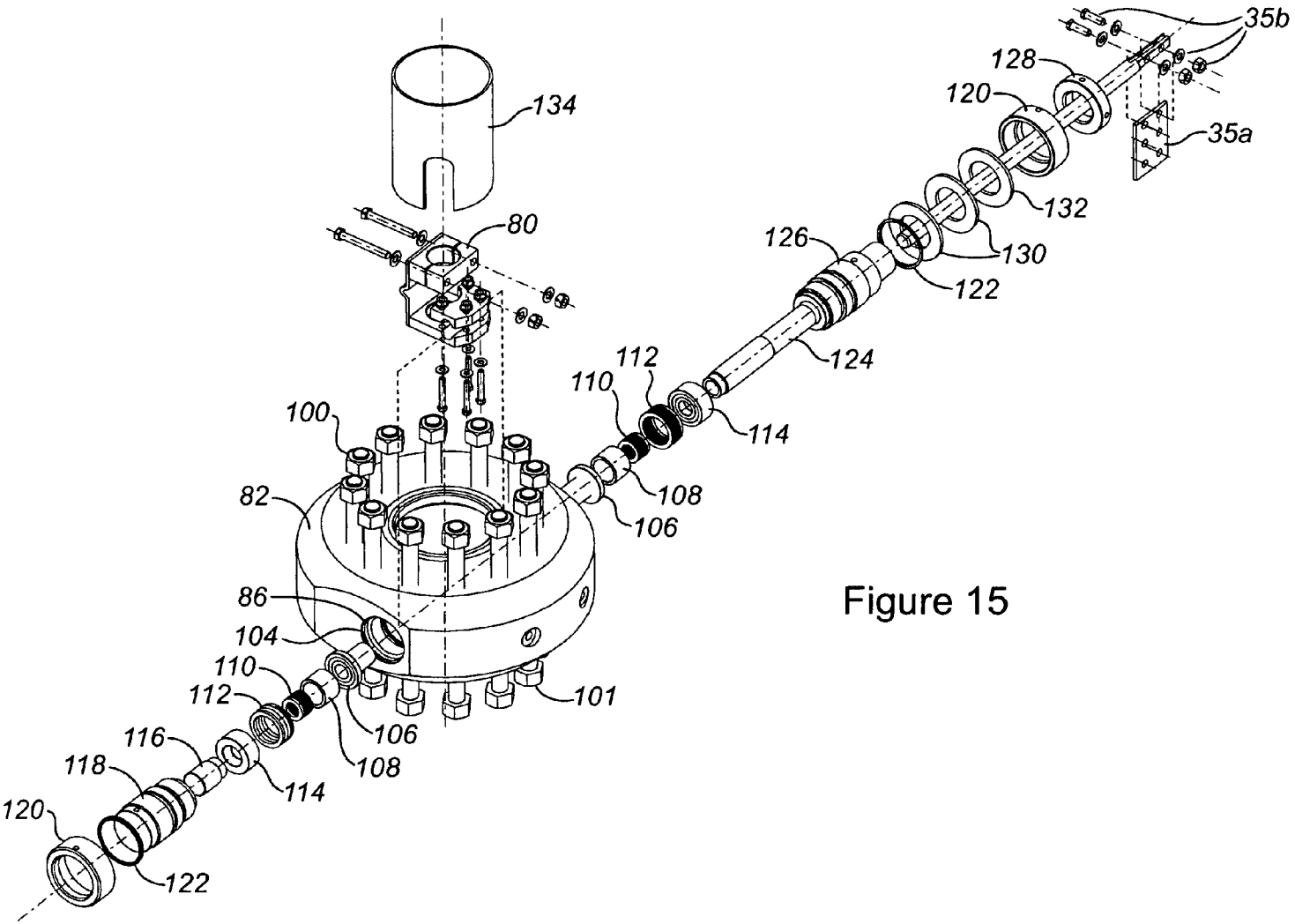

In FIG. 11, the multiple wellhead body members 12 are shown to include, from top down, a tubing head adapter 30, an electrical feed through spool 82, a tubing head 18" and a neutral connection tubing head 20. The tubing head adapter 30 is shown to connect to conventional wellhead equipment located thereabove, such as the gate valve 31 and blind flange 32. The neutral connection tubing head 20 is shown connected to conventional surface casing and wellhead equipment 33.

The wellhead body members 12 of this invention may be combined as one or more wellhead body members within the scope of this invention. In this particular embodiment, the provision of the electrical feed through spool 82 above the tubing head 18", with a back pressure valve being provided therein as described below, allows for ease in running the electrically isolated tubing hanger 24" and making the electrical connection while the wellhead is under pressure.

The body member parts 82, 18", and 20 are shown as having studded connections top and bottom, although alternate connectors such as threaded or flanged, are possible. Each of these body members, when connected, forms a vertical wellbore 11 extending there through. The tubing head 18" forms a hanger profile 22 to land and seal the isolated tubing hanger 24", while the grounding tubing head 20 forms a hanger profile 26 for the grounding tubing hanger 28, such that the tubing hangers 24" and 28 are in a vertically stacked relationship to suspend respectively the conducting tubing 14 and the grounding tubing 16 in concentric relationship.

Hot Electrical Connection

The hot electrical connection is provided from the hot electrical connection assembly 35 through the electrical feed through spool 82. The vertical wellbore 11 extends through the spool 82 to provide a clamp bore for the clamp assembly 80. The spool 82 is shown with top and bottom studded connections 100, 101 to wellhead equipment located above and below, although alternate connectors may be used. The spool 82 is formed with a horizontal conduit 86 extending there through, which provides access to the vertical bore 11. An electrical conductive rod 84 is sealed through an electrical isolation assembly 85 into the horizontal conduit 86 bore between an electrical connection end 102 and a plug end 104 of the bore 86. The electrical connection end 102 provides for hot electrical connection to an electrical connection plate **35*a*, which is bolted by connectors 35*b* to the rod 84 for connection to a source of current at the hot connection assembly 35. The conductive rod 84 is connected to the electrical clamp assembly 80, which in located in the vertical bore 11 to provide for electrical connection between the conductive rod 84 and the electrically isolated tubing hanger 24". As shown in the Figures, the conductive rod 84 is preferably pressure balanced, so extends through the vertical bore 11 and is sealed in the horizontal conduit 86 of the spool 82 on both sides. Alternatively, the conductive rod 84 could end at the clamp assembly 80**.

Electrical Isolation Assembly

In order to seal and electrically isolate the conductive rod 84 from the spool 82, the rod 84 is held within the horizontal conduit 86 by an electrical isolation assembly 85. This assembly includes, around the conductive rod 84 at the clamp assembly 80, a pair of pack off bushings 106 such as Teflon® sleeves, a pair of pack off gland inserts 108, formed of a PEEK material, a pair of inner and outer packing rings 110, 112, such as Teflon®, and a pair of packing glands 114, formed from a PEEK material. At the plug end 104 of the horizontal conduit 86, the rod 84 is held within an end cap 116, formed from example Teflon®. A packing gland retainer 118 is threaded at its inner end into the end of the horizontal conduit 86 to retain the packing and electrical isolation items 106, 108, 110, 112, and 114. The outside diameter of the packing gland retainer 118 is threaded to mount a lock nut 120, which prevents the packing gland retainer 118 from backing out of the spool 82. The lock nut 120 is preferably formed from a non-magnetic material limit eddy current heating. A wiper ring 122 around the packing gland retainer 118 keeps the thread free of debris while preventing pressure build up at the end of the rod 84.

At the electrical connection end 102 of the horizontal conduit 86, the rod 84 is held within a bushing 124, formed for example from Teflon®, which in turn is held within a packing gland retainer 126 (similar to 118) which is threaded at its inner end into the horizontal conduit 86. The packing gland retainer 126 retains the packing and electrical isolation items 106, 108, 110, 112, 114 and 124. The outside diameter of the packing gland ring 126 is threaded to mount to a lock nut 120 (as above) with a wiper ring 122 (as above) to hold the packing gland ring 126 within the horizontal conduit 86. At the outer end of the packing gland retainer 126, a nut 128 is used to attach to the electrical box 34. Rubber washers 130 and flat washer 132 seal between the nut 128 and the packing gland retainer 126.

Clamp Assembly

Figure 16:
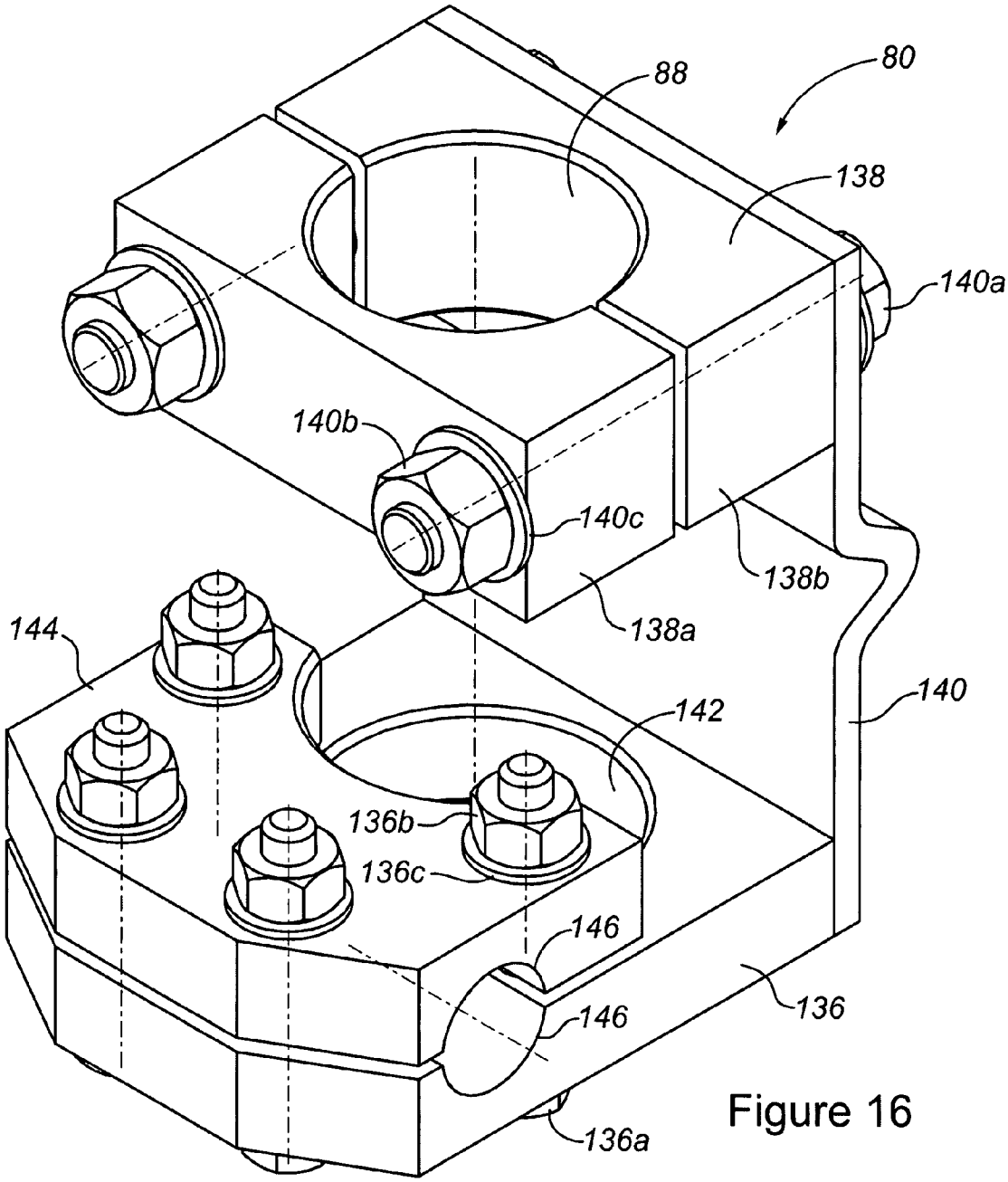
Figure 17:
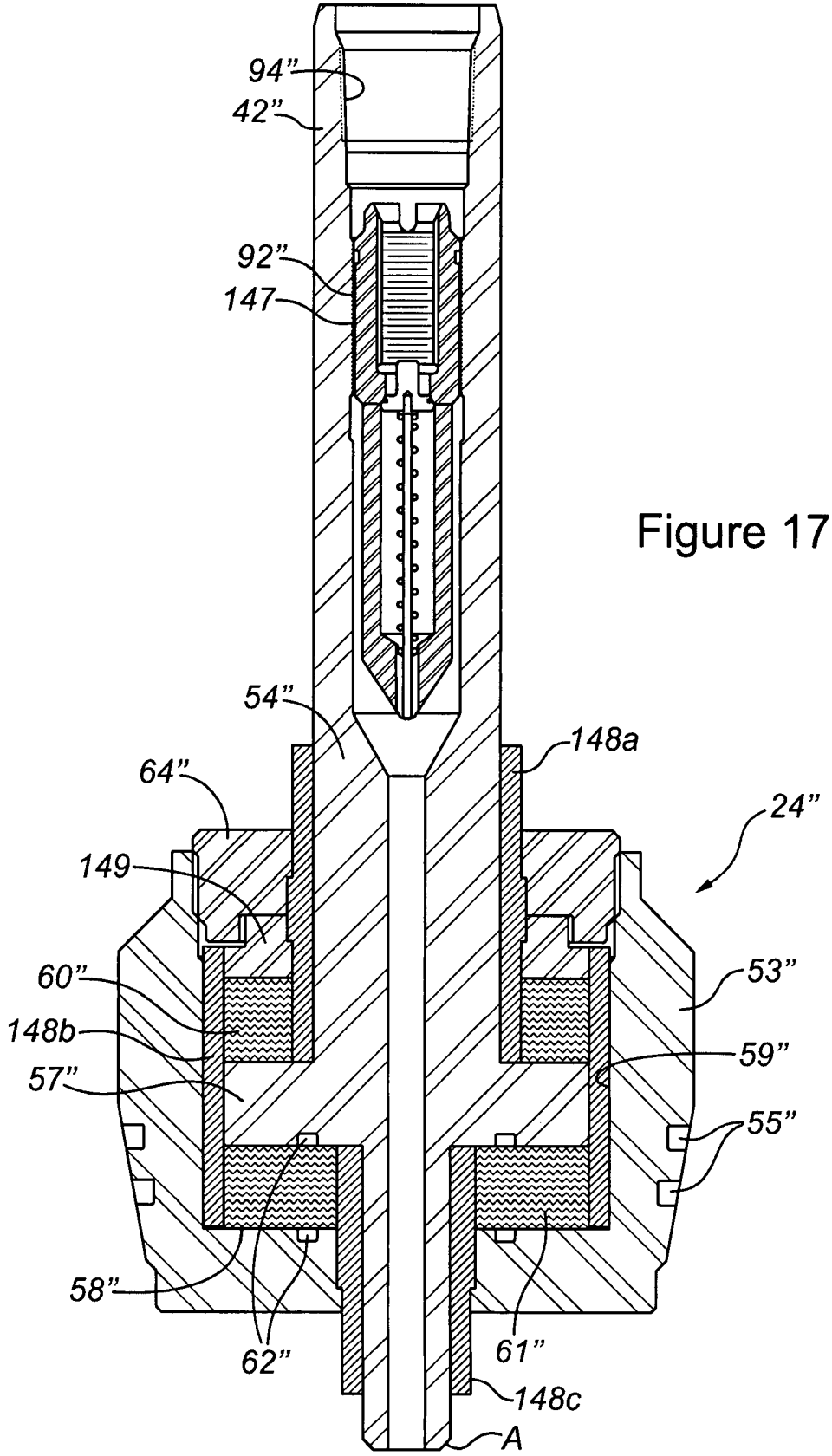
Figure 18:
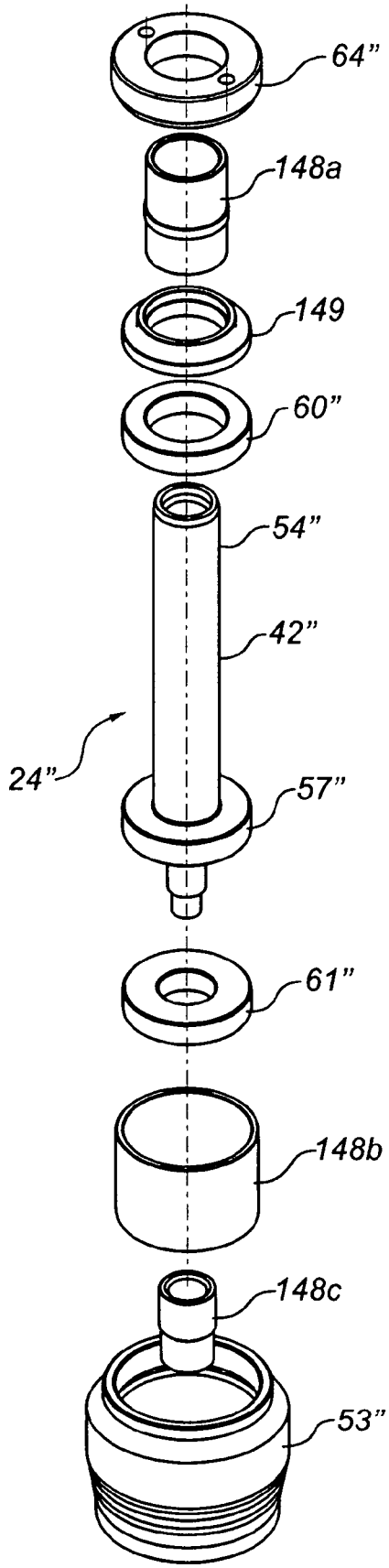
Figure 19:
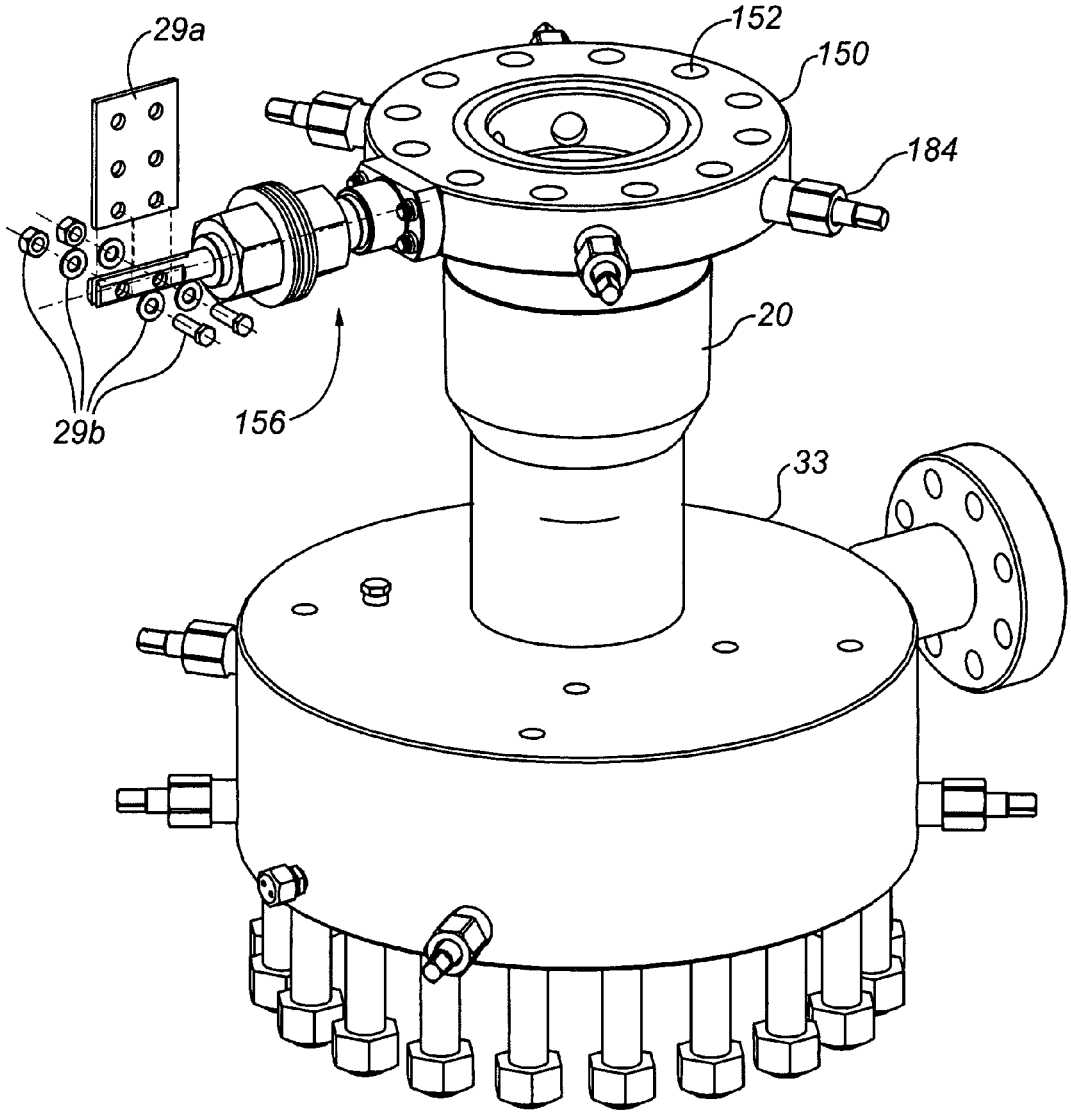
Figure 20:
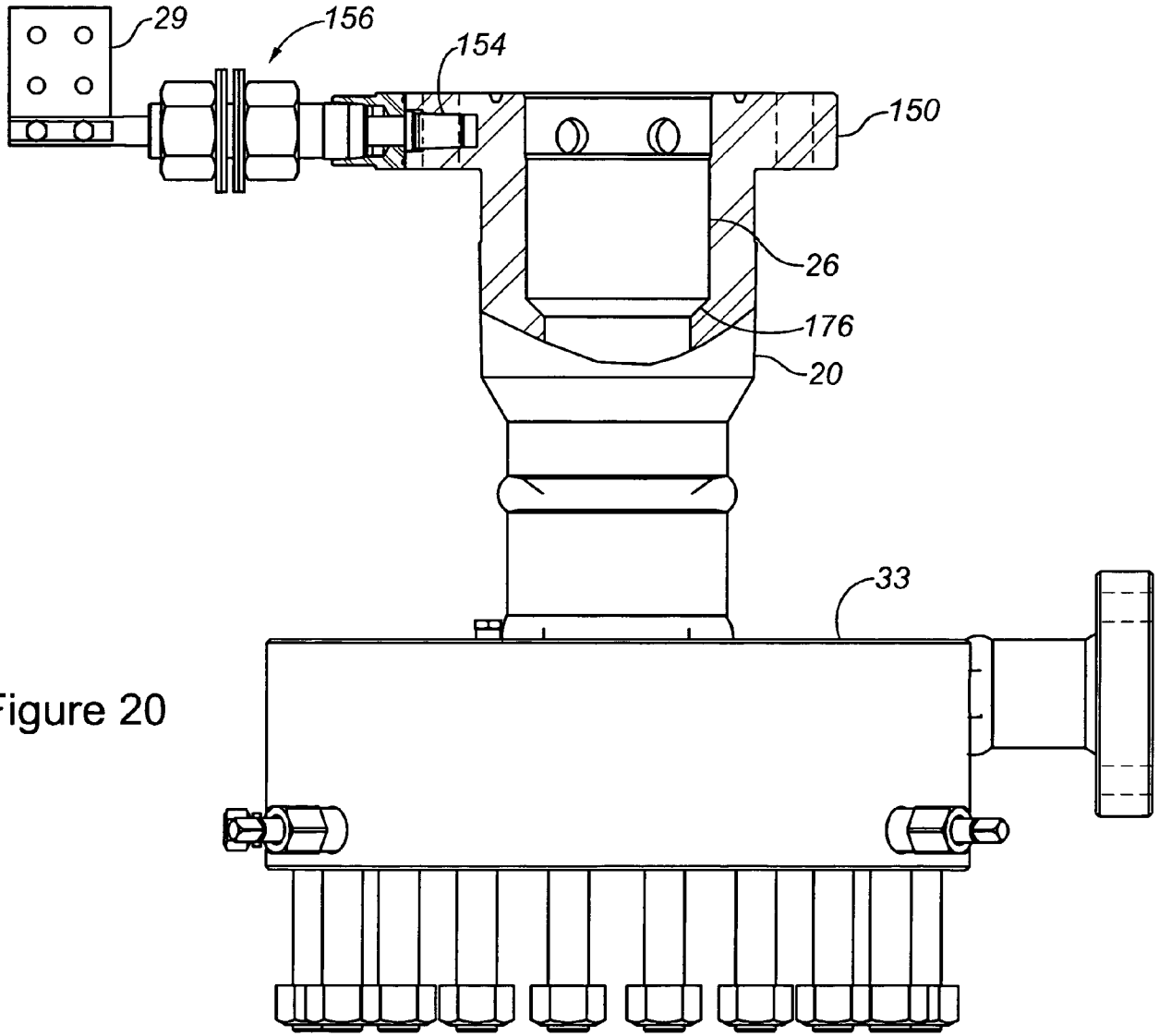

The clamp assembly 80 is held within the vertical bore 11 within an electrical isolation sleeve 134 (see FIG. 15), made for example from Teflon® to provide electrical isolation between the clamp assembly 80 and the electrical spool 82. In FIG. 16, a preferred embodiment of the clamp assembly 80 includes a five-part clamp body made of electrically conductive material such as copper. This provides a clamp assembly 80 which is easy to assemble while being functional to clamp together, for direct electrical connection, the conductive rod 84 and the conducting portion of the tubing hanger 24". The clamp assembly 80 includes a bottom plate 136 and a top plate 138 connected by a side bracket 140. The top plate 138 is formed of two top plate portions 138*a*, 138*b* each of which includes a central semi-circular cutout portion (i.e., semi-circular in horizontal cross section) sized such that they together form a neck extension bore 88 for the neck extension 42" of the isolated tubing hanger 24". The top plate portions 138*a*, 138*b* are connected to each other by cap screws, bolts and washers 140*a*, 140*b*, 140*c*, so as to clamp to the neck extension 42" of the tubing hanger 24". The bottom plate 136 forms a circular cutout portion 142 sized to accept the neck extension 42" of the isolated tubing hanger 24". A middle plate 144 of the clamp assembly 80 is bolted (cap screws, bolts, washers 136*a*, 136*b* and 136*c*) above the bottom plate 136. Each of the middle and bottom plates 144, 136 is formed with semi-circular groove 146 (i.e., semi-circular in vertical cross-section) for tight fitting relationship with the conductive rod 84. Thus, the clamp assembly 80, when positioned in the vertical bore 11 clamped around the neck extension 42" of the isolated tubing hanger 24" and the conductive rod 84, provides direct electrical connection from the conductive rod 84 through to the conducting tubing string 14 which is suspended from the neck extension 42", for example by welding.

The clamp assembly 80 is formed of electrically conductive material with low electrical resistance, such as copper, which may be tin plated for good electrical connection to the conductive rod 84 and the tubing hanger 24". The cap screw, bolts and washers (136*a,b,c* and 140*a,b,c*) may be made of silicon bronze to provide good electrical conductivity.

While it is within the scope of the present invention to have the clamp assembly 80 directly onto the conducting tubing string 14, it more preferably clamps onto the neck extension 42" of the isolated tubing hanger 24", as described herein.

Isolated Tubing Hanger

The isolated tubing hanger 24" is similar to that shown for the first and second embodiments, except that the spacings for insulation purposes are replaced by insulation sleeves, as described below. The hanger 24" includes a pressure containing body housing 53", operative to land and seal within the tubing hanger profile 22" of the tubing head 18". Double O-ring seals 55" are provided in the external tapered surface of the housing 53" to seal in the vertical bore 11 of the tubing head 18". The housing 53" forms a central bore 59" extending there through with a landing seat 58" at its lower end. A generally cylindrical landing coupling 54" having a widened landing shoulder 57" seats in the central bore 59" on the landing seat 58". The conducting tubing string 14 is welded at A to the lower end of the landing coupling 54". Alternate connections for the conducting tubing string 14 may be used, for example slip lock or threaded connections, as are well known in the art, but welding is preferred for electrical conductivity.

The landing coupling 54" is made of an electrically conductive material with good strength. The upper end of the landing coupling 54" provides the upwardly extending neck extension 42" of the isolated tubing hanger 24" onto which the clamp assembly 80 is fastened. The landing coupling 54" forms a central bore 94" operative to pass fluids, tools or instrumentation. Formed in the central bore 94" within the neck extension 42" is a back pressure valve profile 92", top threaded for a back pressure valve (BPV) 147, which may be of known and varied design, but allows for the wellhead members located thereabove to be accessed while the well is under pressure. In the Figures the back pressure valve is shown as a Type H one way BPV (threaded in), but alternate one way or two way BPVs may be used, as known in the art. The provision of this back pressure valve in the isolated tubing hanger 24" also allows for connection of the clamp assembly 80 for the hot electrical connection while the wellhead is under pressure.

In order to electrically isolate the landing coupling 54" from the housing 53", upper, mid and lower insulating sleeves 148*a*, 148*b*, 148*c*, made for example from Teflon®, are provided between landing coupling 54" and the housing 53". As well, upper and lower electrical insulation plates 60", 61" made from, for example, a PEEK material for electrical isolation and strength, are provided above and below the landing shoulder 57" of the landing coupling 54". An externally threaded retainer ring 64" threads into the central bore 59" at the top of the housing 53" against a packing ring 149 to retain all internal components in the housing 53" in electrically isolated and sealing arrangement. O-ring seals 62" are provided above and below the lower electrical insulation plate 61" to provide a seal between the landing coupling 54" and the housing 53".

Neutral or Grounding Connection

The neutral or grounding connection tubing head 20 is shown in FIGS. 19-22. As generally noted above, the wellhead body members could be provided as a single member. Here, the grounding tubing head 20 could be formed one piece with the tubing head 18", but is shown as a separate member in this preferred embodiment. The top flange 150 of the grounding tubing head 20 is shown with studded up connections 152 to the tubing head 18' located thereabove. The bottom portion of the tubing head 20 provides connection to well known surface casing and associated wellhead equipment shown generally at 33, which does not concern the present invention. The intermediate portion of the tubing head 20 forms a tubing hanger profile 26 in its central vertical wellbore 11, to support and seal to the grounding or neutral connection tubing hanger 28, which in turn in operative to suspend the grounding tubing string 16, attached for example by welding at the lower end of the tubing hanger 28.

The top flange 150 of the tubing head 20 is formed with a receptacle 154 proximate the grounding tubing hanger 28. A neutral rod connection assembly 156 connected to grounding connection assembly 29, is held in the receptacle 154 to provide a grounding connection to the grounding tubing string 16, thus grounding the tubing head 20.

The neutral rod connection assembly 156 includes an electrically conducting grounding rod 158, which may for example be made from tin plated copper rod for low electrical resistance. The grounding rod 158 transfers electrical current from the grounding tubing head 20 (and the hanger 28 and tubing string 16) to the ground connection assembly plate 29*a*, as above described. The rod 158 is bolted to the plate 29*a* by nut and bolt connectors 29*b* (see FIG. 19). A protector sleeve 160 surrounds the grounding rod 158 to protect it from the environment. The sleeve 160 is threaded into an internally threaded mounting ring 162, which in turn is bolted onto the top flange 150 of the tubing head 20. Nuts 164*a*, steel washers 164*b* and rubber washers 164*c* fasten around the grounding rod 158 to the electrical junction box 34 (shown in outline in FIG. 22). An O-ring seal 166 is included between the mounting ring 162 and the top flange 150. A further O-ring seal 168 is provided between the protector sleeve 160 and the grounding rod 158 on the junction box side.

Figure 21:
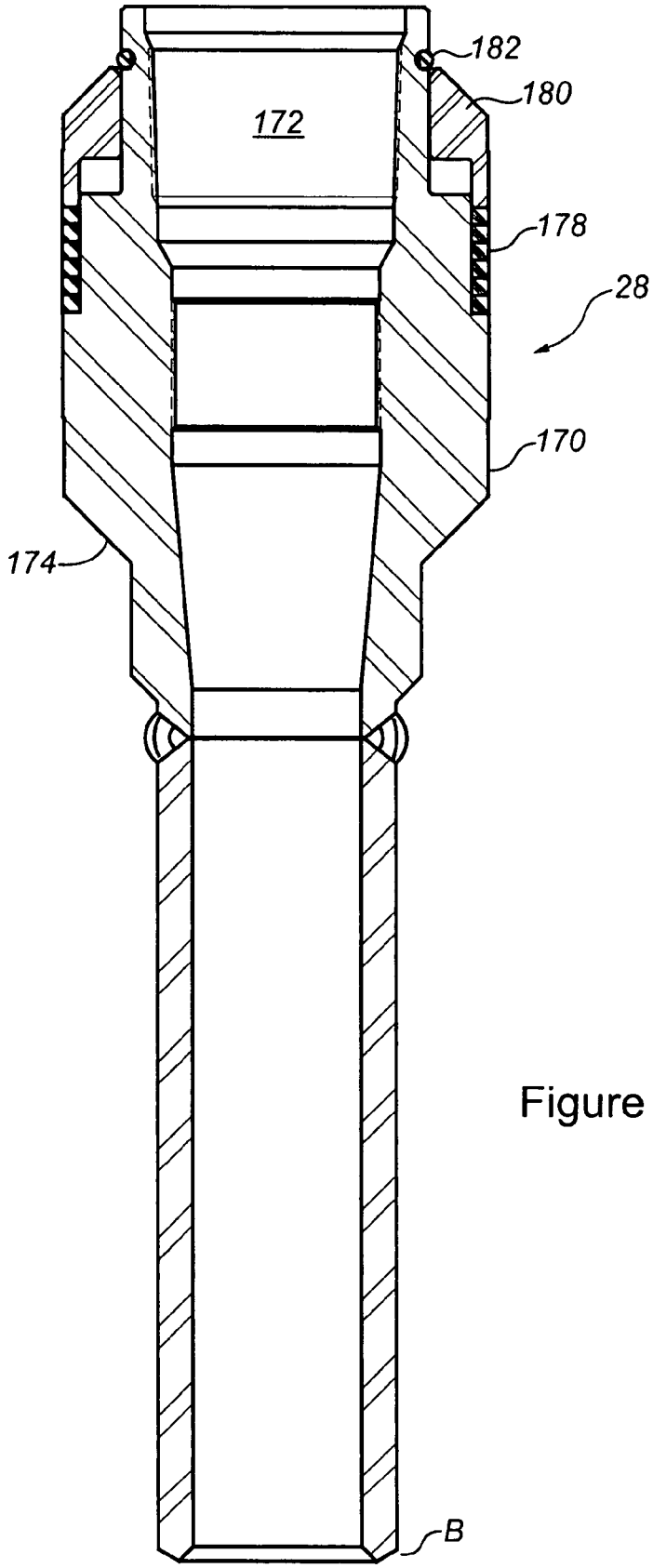
Figure 22:
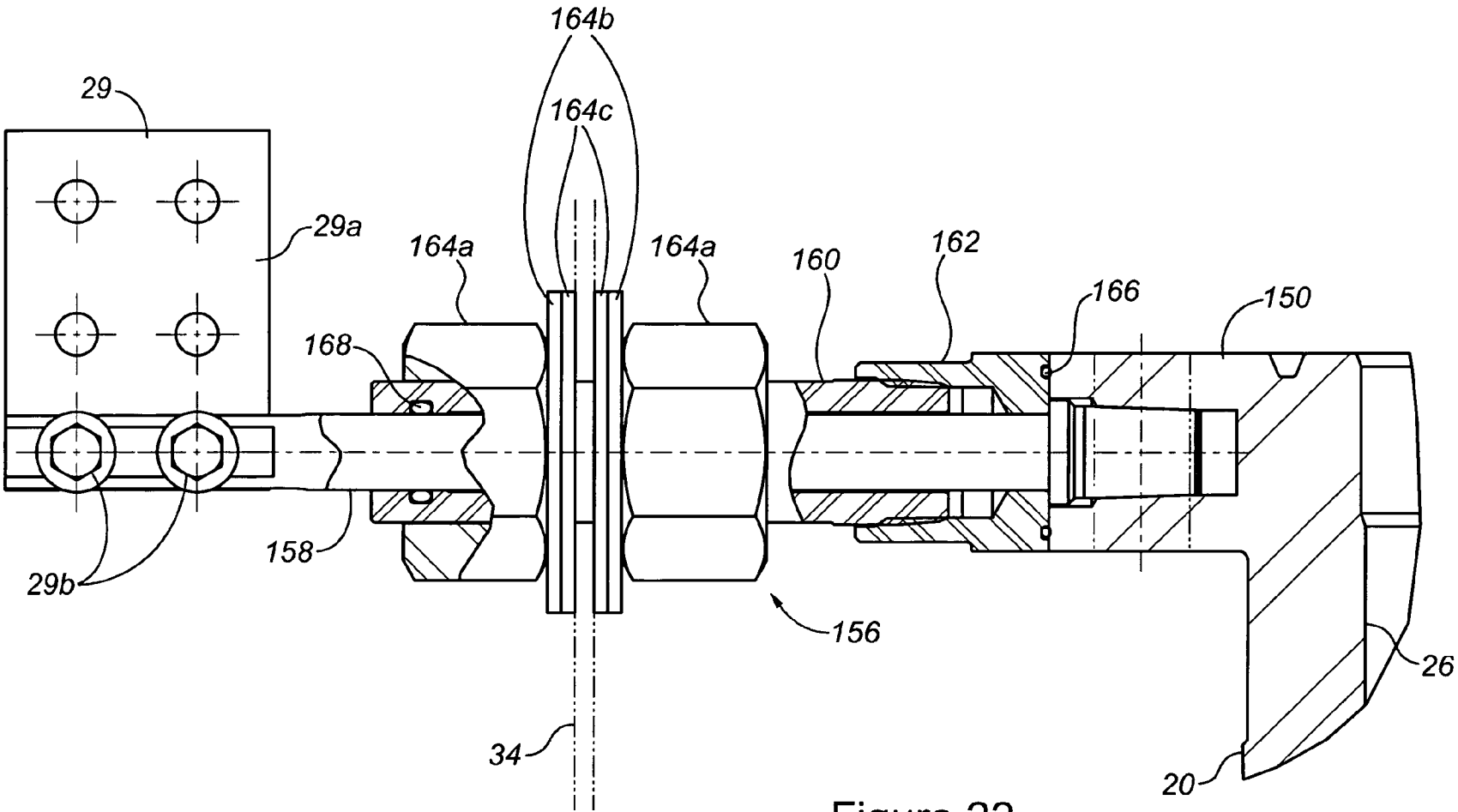

The grounding tubing hanger 28 is best shown in FIG. 21 to include a pressure containing body 170 formed with an internal bore 172 threaded and sized to accept a back pressure valve (not shown) and an external profile to mate with the tubing hanger profile 26 of the tubing head 20. This external profile includes a load shoulder 174 to seat within an inwardly extending circumferential seat 176 in the tubing hanger profile 26 of the tubing head 20. This load shoulder 174 and seat 176 provide the primary electrical contact between the tubing hanger 28 and the tubing head 20. The grounding tubing string 16 is connected at the bottom of the tubing hanger 28 by welding at B. Alternates modes of connecting the grounding tubing string 16 such as slip lock connections or threaded connection may be used, but welding is preferred for electrical conductivity reasons. The grounding tubing hanger 28 carries a plurality of packing rings 178 formed for example of conductive Grafoil® (95% carbon) held in place by a top ring 180 and a retainer ring 182. The top ring 180 moves downwardly against the packing rings 178 when a plurality of tubing head lockscrews 184, extending through the top flange 150 of the tubing head 20 in are tightened.

Figure 23:
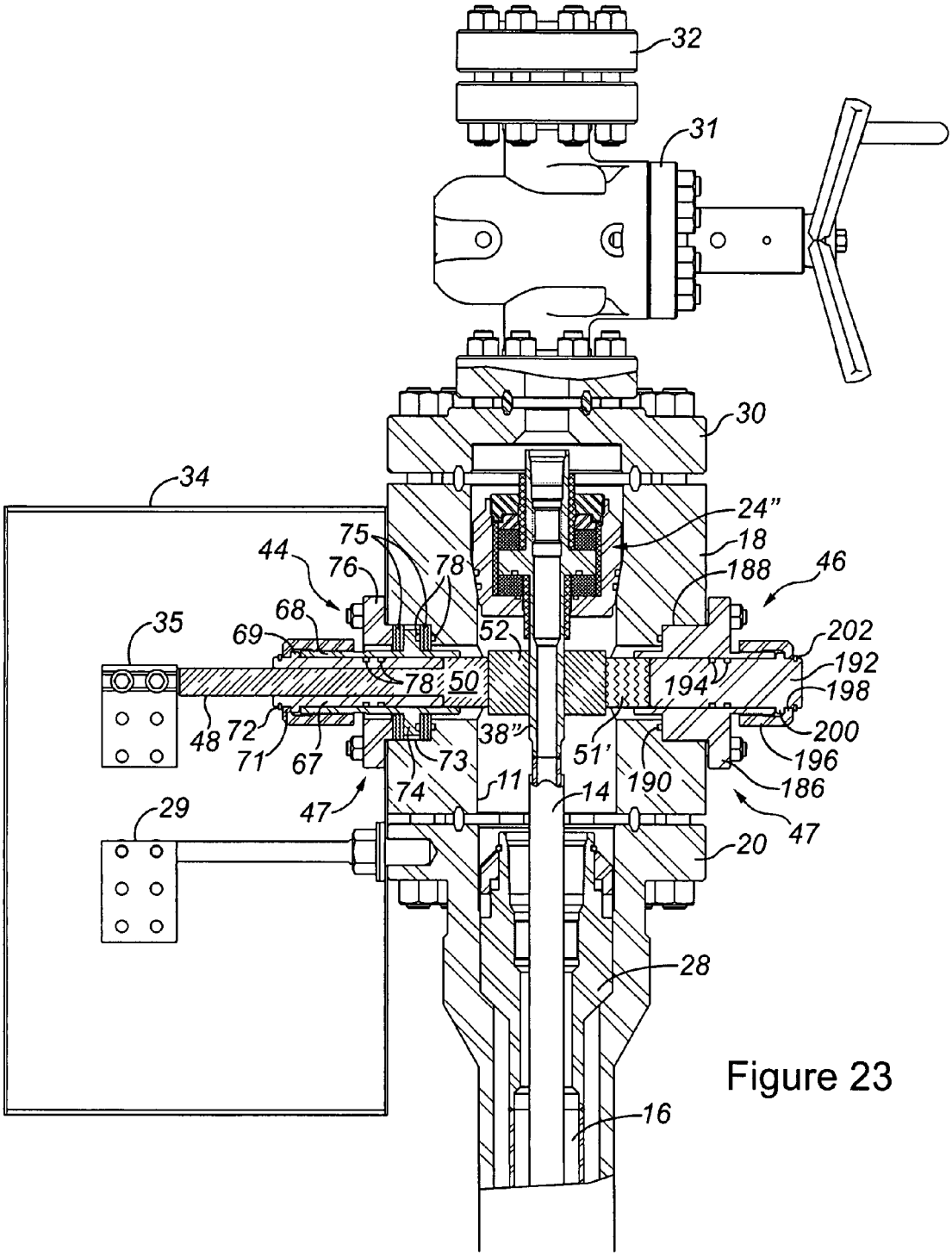
FIG. 23 is a side view, partially in section of a fourth embodiment of the invention, in which a ram connection is used for the hot electrical connection, but wherein the isolated tubing hanger from the third embodiment is somewhat modified for use with the ram connection, and wherein the supporting ram assembly includes a ram formed of insulating material.

Fourth Embodiment—Ram Connection, FIG. 23

FIG. 23 shows a ram connection of the present invention utilizing the isolated tubing hanger 24" of the third embodiment, but having a downwardly extending neck extension 38" as described for the first embodiment for hot connection to the ram assemblies 44, 46. This embodiment also differs from the first embodiment in that the electrical isolation assembly 47 on the support ram assembly 46 is simplified by reason of the head of the support ram 51' being itself formed of an electrical insulating material such as PEEK. Compared to the first embodiment, the function of the ram housing is now provided in the fourth embodiment by an altered support retainer ring 186 bolted to the outer wall of the tubing head 18, and sealed in the seal pocket 188 with O-ring seal 190. The support actuation rod 192 is sealed through O-ring seals 194 within the support retainer ring 186. The actuation nut 196 is fixed around the end of the support actuation rod 192, with the inner lip 198 of the nut 196 being held between outwardly extending rings 200, 202 fixed to or integral with the support actuation rod 192. The actuation nut 196 is threaded onto the outwardly protruding end of the support retainer ring 186, such that engaging and disengaging the threads on the nut 196 extends and retracts the support actuation rod 192 and thus the ram 51' against the conducting ring 52 in the vertical bore 11. The conductive rod assembly 44 and its isolation assembly 47 is as described in the first embodiment, and is thus labeled as for the first embodiment in FIG. 23.

Fifth Embodiment—Hot Electrical Connection Outside the Wellhead—FIGS. 24-26

In some applications, it may be preferable to simplify the hot connection to the isolated tubing hanger, providing the hot electrical connection outside the wellhead, rather than through a conduit. Such applications include those where access to the bore of the conductive tubing is not needed, and/or applications where further wellhead equipment is not needed above the hot connection. In this fifth embodiment, a conduit in the wellhead body members 12 is eliminated, and the hot connection can be made directly or indirectly to the hot components of the isolated tubing hanger outside the wellhead.

In the preferred embodiment shown in FIGS. 24-26, the wellhead assembly 10''' includes a grounding tubing head 20''', tubing head 18''' and tubing head adapter 30''', all flange connected in ascending order. The components of the grounding tubing head 20''', and grounding tubing hanger 28''' are as described above, and are thus labeled with the same reference numerals. However, whereas for the above embodiments, the grounding connection 29 is preferably located proximate the grounding tubing head 18 (due to proximity of the electrical junction box 34), in the fifth embodiment this grounding connection 29''' is preferably being made outside the wellhead members 12, within electrical junction box 34''' to further simplify this connection. The grounding tubing head 18''' and grounding tubing hanger 28''' are otherwise identical to that described for the previous embodiments, except that the neutral rod connection assembly 156 to the top flange 150 of the tubing head 18 is not needed. To that end, the neutral connection assembly 29''' is shown in FIG. 24 to include grounding plates 302 bolted to the top of the tubing head adapter 30''', and connecting to electrical cables 304 running back to the power source (not shown). As well, to ensure good grounding of the wellhead members 12, flange jumper cables 306 are bolted to flange grounding plates 308 on the top and bottom flanges or connectors of the interconnected wellhead body members (i.e., between top flange 150''' of neutral tubing head 20''' and bottom flange 150*a* of tubing head 18''', and between top flange 150*b* of tubing head 18''' and bottom 150*c* of tubing head adapter 30'''). These jumper cables 306 are optional, but particularly for high voltage applications, they are preferred for extra assurance of grounding.

The hot electrical connection assembly 35''' is shown in FIG. 24 to include a clamp connection assembly 300 connecting power cables 310 to the extended neck portion 42''' of the isolated tubing hanger 24'''. The clamp assembly 300 includes a conductive clamp 312 formed with a bore 314 to accommodate the extended neck portion 42'''. The clamp 312 is bolted with bolts 316 and plates 318 to the power cables 310.

The neutral and hot connection assemblies 29''' and 35''' are preferably housed in the electrical junction box 34''', which in turn is bolted with bolts 320 above the tubing head adapter 30'''.

The tubing head 18''', and isolated tubing hanger 24''' are similar to that described above. The tubing hanger 24''' may be modified as follows provided no vertical access is required to the conductive tubing string 14. Firstly, the landing coupling 54''', with its extended neck portion 42''', is formed preferably as a solid member (and thus without a central bore, and thus without the back pressure valve profile shown in the previous embodiments). This allows the electrical connection to be made to this extended neck portion 42''' above the wellhead members. A landing tool profile 322 is formed at the upper end of the extended neck portion 42''' in order to land the tubing hanger 24''' in the tubing head 18'''. The upper, mid and lower insulating sleeves 148*a*'''', 148*b*'''', and 148*c*'''', and the upper and lower electrical insulation plates 60''', 61''' are all preferably threaded in order to connect to each other. This threaded connection of these insulation members is found to increase the surface area along the threads, to thereby increase the creepage gap provided by the threads. The result is better electrical isolation, making it possible to reduce the size of the components and spacing needed for high voltage applications.

The tubing head adapter 30''' provides an extension to the vertical wellbore 11, which extends therethrough. The extended neck portion 42''' of the landing coupling 54''' extends through this central bore portion 323 of the vertical wellbore 11, preferably terminating outside the wellhead. In order to electrically isolate the tubing head adapter 30''', additional pressure load supporting insulating rings 324, 326 and insulating sleeve 328 are provided, in ascending order, between the extended neck portion 42''' and the central bore 323 in tight fitting, sealing and electrical isolating relationship. The insulating rings 324, 326 and sleeves 148*a*'''', 328 are preferably formed to slide together in a manner that provides overlap between the adjacent rings and/or sleeves so as to increase creepage gap and thus increase electrical isolation. Lower ring 324 is preferably formed with a downwardly projecting circular rim 330 to slide over sleeve 148*a*''''. A circular groove 332 is preferably formed in the upper surface of lower ring 324. Upper ring 326 is preferably formed with a downwardly projecting circular rim 334 at its lower surface to fit into the circular groove 332 of the lower ring 324. A plurality of V-shaped inner and outer packing rings 336, 337 are stacked in sets between the rings 324, 326, on either side of the downwardly projecting rim 334 to provide a seal to the central bore 323, and to further isolate the extended neck 42''' of the tubing hanger 24'''. Other seals may be used, for example one set of V-shaped packing rings or other seals. However, the sets of V-shaped packing rings 336, 337 are preferred, since they provide reliable sealing and electrical isolation from the extended neck portion 42''' for the temperatures encountered during operation. This is particularly useful in high voltage applications. The V-shaped packing rings 336, 337 may be of known sealing and electrically insulating materials, but are most preferably provided as Teflon® spring energized ring seals for electrical isolation and sealing. The upper ring 326 is formed with a circular cutout 340 adjacent the extended neck 42''' in order to accommodate the insulating sleeve 328. The insulating sleeve 328 extends upwardly from the wellhead assembly 10 to insulate the extended neck 42''' above the wellhead in the electrical junction box 34. A retainer ring 338 is bolted above the tubing head adapter 30''', around the insulating sleeve 328. A widened portion 342 of the insulating sleeve 328 is held in a cut away portion 344 of the retainer ring 338, such that bolting down of the retainer ring 338 retains the packing rings 336, 337 to seal the bore 323 through the tubing head adapter 30'''.

As set forth above, the insulating sleeves which are not load bearing, including 148*a*'''', 148*b*'''', 148*c*'''' and 328 may be made from known insulating materials, preferably from Teflon®. The load bearing insulating components, including electrical insulating plates 60''', 61''', and rings 324 and 326 are preferably made from an insulating material that provides extra strength, for example PEEK. It should be understood that one or more of the insulating rings, sleeves or plates described for this and other embodiments, might be made varied within the scope of the invention. For instance, one or more of the insulating members may be formed integral with another insulating member. One example is that insulating sleeve 328 could be combined with insulating ring 326, in which case, this combined part is preferably formed from PEEK.

All references mentioned in this specification are indicative of the level of skill in the art of this invention. All references are herein incorporated by reference in their entirety to the same extent as if each reference was specifically and individually indicated to be incorporated by reference. However, if any inconsistency arises between a cited reference and the present disclosure, the present disclosure takes precedence. Some references provided herein are incorporated by reference herein to provide details concerning the state of the art prior to the filing of this application, other references may be cited to provide additional or alternative device elements, additional or alternative materials, additional or alternative methods of analysis or application of the invention.

The terms and expressions used are, unless otherwise defined herein, used as terms of description and not limitation. There is no intention, in using such terms and expressions, of excluding equivalents of the features illustrated and described, it being recognized that the scope of the invention is defined and limited only by the claims which follow. Although the description herein contains many specifics, these should not be construed as limiting the scope of the invention, but as merely providing illustrations of some of the embodiments of the invention.

One of ordinary skill in the art will appreciate that elements and materials other than those specifically exemplified can be employed in the practice of the invention without resort to undue experimentation. All art-known functional equivalents, of any such elements and materials are intended to be included in this invention. The invention illustratively described herein suitably may be practiced in the absence of any element or elements, limitation or limitations which is not specifically disclosed herein.

As used herein, "comprising" is synonymous with "including," "containing," or "characterized by," and is inclusive or open-ended and does not exclude additional, unrecited elements. The use of the indefinite article "a" in the claims before an element means that one or more of the elements is specified, but does not specifically exclude others of the elements being present, unless the contrary clearly requires that there be one and only one of the elements.

We claim:

1. A wellhead assembly for providing a power connection to a downhole electrical device, comprising:

a. one or more pressure-containing wellhead body members enclosing a vertical wellbore extending there through, the one or more body members supporting, in sealed relationship in the vertical wellbore, an isolated tubing hanger and a grounding tubing hanger, the isolated tubing hanger suspending therefrom a conducting tubing string, and the grounding tubing hanger suspending therefrom a grounding tubing string concentrically spaced from the conducting tubing string, both of the tubing strings being electrically conductive and electrically connected to the downhole electrical device, and wherein the wellhead body members include a tubing head operative to support the isolated tubing hanger, a tubing head adapter connected and sealed above the tubing head, and an electrical junction box mounted above the tubing head adapter;

b. the isolated tubing hanger having an outer housing which seats in the vertical wellbore of the tubing head, an inner electrically conducting portion supported by the outer housing and including a conducting neck portion extending upwardly above the outer housing, through the tubing head adapter and ending outside the vertical wellbore for electrical connection, the conducting neck portion being operative to provide electrical connection to, and suspend, the conducting tubing string, and insulation between the outer housing and the conducting portion to electrically isolate the outer housing from the conducting portion;

c. a hot electrical connection for making an electrical connection the conducting portion of the isolated tubing hanger, and including a conductive clamp assembly operative to clamp onto the conducting neck portion of the isolated tubing hanger outside the vertical wellbore in the isolated electrical junction box for electrical connection outside the vertical wellbore;

d. electrical isolation associated with the hot electrical connection and the one or more wellhead body members for sealing and electrically isolating the hot electrical connection such that the one or more wellhead body members remain electrically isolated from the hot electrical connection, wherein the electrical isolation includes i. upper and lower load supporting insulating rings around the conducting neck portion of the isolated tubing hanger;

ii. asking rings between the upper and lower insulating rings to seal the conducting neck portion in the vertical bore of the tubing head adapter;

iii. a retainer ring fastened around the conducting neck portion of the isolated tubing hanger at the to of the tubing head adapter; and iv. an insulating sleeve, separate from or integral with, the upper insulating ring around the conducting neck portion and extending through the retainer ring above the tubing head adapter such that the retainer ring retains the electrical isolation to seal the vertical wellbore through the tubing head adapter;

e. a grounding connection connected to the one or more wellhead body members for making a ground connection to the grounding tubing string; and f. a source of current having a first connection to the hot electrical connection and a second connection to the grounding connection.

2. The assembly as set forth in claim 1, wherein:

the one or more body members form separate first and second tubing hanger profiles in the vertical wellbore to support and seat the grounding tubing hanger and the isolated tubing hanger in vertically stacked relationship in the vertical wellbore.

3. The assembly as set forth in claim 2, wherein the isolated tubing hanger is located vertically above the grounding tubing hanger, and wherein the conducting tubing string suspended from the isolated tubing hanger is the inner of the concentrically arranged tubing strings.

4. The assembly as set forth in claim 3, wherein one or more of the insulating sleeve, upper and lower insulating rings and packing rings slide together in an overlapping manner to increase creepage gap and improve electrical isolation.

5. The assembly as set for in claim 4, where the packing rings include a plurality of stacked inner and outer V-rings separated by a downwardly extending circular rim on the upper insulating ring, and wherein the circular rim fits into a circular groove on the lower insulating ring, such that fastening of the retainer ring onto the tubing head adapter retains the upper and lower insulating rings and the packing rings in a manner to seal the vertical wellbore and the conducting neck portion of the isolated tubing hanger.

6. The assembly as set forth in claim 5, wherein the one or more wellhead body members further comprises a separate grounding tubing head connected below the tubing head for the isolated tubing hanger, the grounding tubing head being operative to support the grounding tubing hanger, and the grounding connection being made to the tubing head adapter.

7. The assembly as set forth in claim 3, wherein the one or more wellhead body members further comprises a separate grounding tubing head connected below the tubing head for the isolated tubing hanger, the grounding tubing head being operative to support the grounding tubing hanger, and the grounding connection being made to the tubing head adapter.

8. A hot electrical connection assembly in a wellhead for providing a power connection to a tubing string extending to a downhole electrical device, comprising:

a. one or more pressure-containing wellhead body members enclosing a vertical wellbore extending there through, the one or more body members supporting, in sealed relationship in the vertical wellbore, an isolated tubing hanger, the isolated tubing hanger suspending therefrom a conducting tubing string electrically connected to the downhole electrical device, and wherein the wellhead body members include a tubing head operative to support the isolated tubing hanger, a tubing head adapter connected and sealed above the tubing head, and an electrical junction box mounted above the tubing head adapter;

b. the isolated tubing hanger having an outer housing which seats in the vertical wellbore of the tubing head, an inner electrically conducting portion supported by the outer housing and including a conducting neck portion extending upwardly above the outer housing, through the tubing head adapter and ending outside the vertical wellbore for electrical connection, the conducing neck portion being operative to provide electrical connection to, and suspend, the conducting tubing string, and insulation between the outer housing and the conducting portion to electrically isolate the outer housing from the conducting portion;

c. a hot electrical connection for making an electrical connection to the conducting portion of the isolated tubing hanger, and including a conductive clamp assembly operative to clamp onto the conducting neck portion of the isolated tubing hanger outside the vertical wellbore in the isolated electrical junction box for electrical connection outside the vertical wellbore; and d. electrical isolation associated with the hot electrical connection and the one or more wellhead members for sealing and electrically isolating the hot electrical connection such that the one or more wellhead body members remain electrically isolated from the hot electrical connection, wherein the electrical isolation includes i. upper and lower load supporting insulating rings around the conducting neck portion of the isolated tubing hanger;

ii. packing rings between the upper and lower insulating rings to seal the conducting neck portion in the vertical bore of the tubing head adapter;

iii. a retainer ring fastened around the conducting neck portion of the isolated tubing hanger at the top of the tubing head adapter; and iv. an insulating sleeve, separate from or integral with, the upper insulating ring around the conducting neck portion and extending through the retainer ring above the tubing head adapter such that the retainer ring retains the electrical isolation to seal the vertical wellbore through the tubing head adapter.

9. The hot electrical connection assembly as set forth in claim 8, wherein the tubing head forms a tubing hanger profile in the vertical wellbore to support and seat the isolated tubing hanger.

10. The hot electrical connection assembly as set forth in claim 9, wherein one or more of the insulating sleeve, upper and lower insulating rings and packing rings slide together in an overlapping manner to increase gap and improve electrical isolation.

11. The hot electrical connection assembly as set for in claim 10, where the packing rings include a plurality of stacked inner and outer V-rings separated by a downwardly extending circular rim on the upper insulating ring, and wherein the circular rim fits into a circular groove on the lower insulating ring, such that fastening of the retainer ring onto the tubing head adapter retains the upper and lower insulating rings and packing rings in a manner to seal the vertical wellbore and the conducting neck portion of the isolated tubing hanger.

12. An isolated tubing hanger for suspending a conducting tubing string within a pressure-containing tubing head, the isolated tubing hanger comprising:

a. an outer housing which seats in the tubing head, an inner electrically conducting portion supported by the outer housing operative to provide electrical connection to, and suspend, the conducting tubing string, and insulation between the housing and the conducting portion to electrically isolate the housing portion from the conducting portion;

b. the housing forming a central bore with an inwardly extending circumferential landing seat at its lower end, and carrying outer circumferential seals to seal with the tubing head;

c. the conducting portion of the isolated tubing hanger including a landing shoulder to seat on the landing seat, and a conducting neck portion connected to, or integral with, the conducting portion extending upwardly relative to the housing, said conducting neck portion providing the electrical connection to the conducting tubing string;

d. the insulation including load supporting insulation plates located above and below the landing shoulder, and a plurality of insulation sleeves between the housing and the conducting portion;

e. one or more seals between the landing shoulder and the landing seat to seal the conducting portion of the isolated tubing hanger with the housing; and f. a retainer ring at the top of the housing around the conducting neck portion to retain, seal and energize the insulation and the one or more seals.

13. The isolated tubing hanger as set forth in claim 12, wherein the insulation plates and the insulation sleeves are threaded together to increase creepage gap and electrical isolation.

* * * * *

UNITED STATES PATENT AND TRADEMARK OFFICE

CERTIFICATE OF CORRECTION

PATENT NO. : 7,552,762 B2
APPLICATION NO. : 11/610345
DATED : June 30, 2009
INVENTOR(S) : Abram Khazanovich et al.

It is certified that error appears in the above-identified patent and that said Letters Patent is hereby corrected as shown below:

In the Claims:

In claim 1(d)(ii), column 19, line 30, please replace "asking rings" with --packing rings--.

Signed and Sealed this

Thirteenth Day of October, 2009

David J. Kappos

David J. Kappos
*Director of the United States Patent and Trademark Office*